US010636646B2

(12) United States Patent
Hoyes et al.

(10) Patent No.: US 10,636,646 B2
(45) Date of Patent: Apr. 28, 2020

(54) ION MIRROR AND ION-OPTICAL LENS FOR IMAGING

(71) Applicants: Micromass UK Limited, Wilmslow (GB); LECO CORPORATION, St. Joseph, MI (US)

(72) Inventors: John Brian Hoyes, Stockport (GB); Anatoly Verenchikov, Montenegro (RU); Mikhail Yavor, St. Petersburg (RU); Keith Richardson, New Mills-High Peak (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 15/778,341

(22) PCT Filed: Nov. 21, 2016

(86) PCT No.: PCT/US2016/063076
§ 371 (c)(1),
(2) Date: May 23, 2018

(87) PCT Pub. No.: WO2017/091501
PCT Pub. Date: Jun. 1, 2017

(65) Prior Publication Data

US 2018/0358219 A1 Dec. 13, 2018

(30) Foreign Application Priority Data

Nov. 23, 2015 (GB) ..... 1520540.4

(51) Int. Cl.
*H01J 49/00* (2006.01)
*H01J 49/40* (2006.01)
(Continued)

(52) U.S. Cl.
CPC ..... *H01J 49/406* (2013.01); *H01J 49/063* (2013.01); *H01J 49/067* (2013.01); *H01J 49/068* (2013.01); *H01J 49/08* (2013.01)

(58) Field of Classification Search
CPC ..... H01J 49/406; H01J 49/08; H01J 49/068; H01J 49/063; H01J 49/067
(Continued)

(56) References Cited

U.S. PATENT DOCUMENTS 4,731,532 A 3/1988 Frey et al.
5,017,780 A 5/1991 Kutscher et al.
(Continued)

FOREIGN PATENT DOCUMENTS

CN 101369510 A 2/2009
CN 102131563 A 7/2011
(Continued)

OTHER PUBLICATIONS

International Search Report and Written Opinion for International Application No. PCT/US2016/063076 dated Mar. 30, 2017.
(Continued)

*Primary Examiner* — Michael Maskell

(57) ABSTRACT

An ion mirror is disclosed comprising an ion entrance electrode section (62) at the ion entrance to the ion mirror, an energy focussing electrode section (66) for reflecting ions back along a longitudinal axis towards said ion entrance, and a spatial focussing electrode section (64) arranged between the ion entrance electrode section (62) and the energy focussing electrode section (66) for spatially focussing the ions. One or more DC voltage supply is provided to apply a DC potential to the ion entrance electrode section (62) that is intermediate the DC potential applied to the spatial focussing electrode section (64) and the DC potential applied to the energy focussing electrode section (66). The
(Continued)

ion mirror further comprises: (i) at least one first transition electrode (68) arranged between said ion entrance electrode section (62) and said spatial focussing electrode section (64), wherein said one or more DC voltage supply is configured to apply a DC potential to said at least one first transition electrode that is intermediate the DC potential applied to the ion entrance electrode section (62) and the DC potential applied to the spatial focussing electrode section (64); and (ii) at least one second transition electrode (69) arranged between said energy focussing electrode section (66) and said spatial focussing electrode section (64), wherein said one or more DC voltage supply is configured to apply a DC potential to said at least one second transition electrode (69) that is intermediate the DC potential applied to the spatial focussing electrode section (64) and the DC potential applied to the ion entrance electrode section (62).

20 Claims, 11 Drawing Sheets

(51) Int. Cl.
*H01J 49/06* (2006.01)
*H01J 49/08* (2006.01)

(58) Field of Classification Search
USPC ..... 250/281, 282, 287
See application file for complete search history.

(56) References Cited

U.S. PATENT DOCUMENTS 5,128,543 A 7/1992 Reed et al.
5,619,034 A 4/1997 Reed et al.
5,654,544 A 8/1997 Dresch
5,955,730 A 9/1999 Kerley et al.
6,013,913 A 1/2000 Hanson
6,020,586 A 2/2000 Dresch et al.
6,107,625 A 8/2000 Park
6,316,768 B1 11/2001 Rockwood et al.
6,384,410 B1 5/2002 Kawato
6,469,295 B1 10/2002 Park
6,489,610 B1 12/2002 Barofsky et al.
6,570,152 B1 5/2003 Hoyes
6,627,877 B1 9/2003 Davis et al.
6,717,132 B2 4/2004 Franzen
6,744,042 B2 6/2004 Zajfman et al.
6,888,130 B1 5/2005 Gonin
6,949,736 B2 9/2005 Ishihara
7,034,292 B1 4/2006 Whitehouse et al.
7,196,324 B2 3/2007 Verentchikov
7,326,925 B2 2/2008 Verentchikov et al.
7,351,958 B2 4/2008 Vestal
7,385,187 B2 6/2008 Verentchikov et al.
7,501,621 B2 3/2009 Willis et al.
7,504,620 B2 3/2009 Sato et al.
7,582,864 B2 9/2009 Verentchikov
7,663,100 B2 2/2010 Vestal
7,709,789 B2 5/2010 Vestal et al.
7,772,547 B2 8/2010 Verentchikov
7,825,373 B2 11/2010 Willis et al.
7,863,557 B2 1/2011 Brown
7,884,319 B2 2/2011 Willis et al.
7,932,491 B2 4/2011 Vestal
7,982,184 B2 7/2011 Sudakov
7,989,759 B2 8/2011 Holle
8,017,907 B2 9/2011 Willis et al.
8,063,360 B2 11/2011 Willis et al.
8,395,115 B2 3/2013 Makarov et al.
8,637,815 B2 1/2014 Makarov et al.
8,642,951 B2 2/2014 Li
8,658,984 B2 2/2014 Makarov et al.
8,853,623 B2 10/2014 Verenchikov
8,921,772 B2 12/2014 Verenchikov
9,082,597 B2 7/2015 Willis et al.
9,082,604 B2 * 7/2015 Verenchikov ..... H01J 49/4245
9,214,322 B2 12/2015 Kholomeev et al.
9,312,119 B2 4/2016 Verenchikov
9,373,490 B1 6/2016 Nishiguchi
9,396,922 B2 7/2016 Verenchikov et al.
9,425,034 B2 8/2016 Verentchikov et al.
9,472,390 B2 10/2016 Verenchikov et al.
9,595,431 B2 * 3/2017 Verenchikov ..... H01J 49/4245
9,683,963 B2 6/2017 Verenchikov
9,728,384 B2 8/2017 Verenchikov
9,779,923 B2 10/2017 Verenchikov
9,786,484 B2 10/2017 Willis et al.
9,865,445 B2 1/2018 Verenchikov et al.
9,870,906 B1 1/2018 Quarmby
9,881,780 B2 1/2018 Verenchikov et al.
2003/0111597 A1 6/2003 Gonin et al.
2004/0084613 A1 5/2004 Bateman et al.
2004/0108453 A1 6/2004 Kobayashi et al.
2004/0119012 A1 6/2004 Vestal
2004/0155187 A1 8/2004 Axelsson
2005/0040326 A1 2/2005 Enke
2005/0103992 A1 5/2005 Yamaguchi et al.
2005/0258364 A1 11/2005 Whitehouse et al.
2006/0169882 A1 8/2006 Pau et al.
2006/0214100 A1 * 9/2006 Verentchikov ..... H01J 49/406 250/287
2006/0289746 A1 12/2006 Raznikov et al.
2007/0023645 A1 2/2007 Chernushevich
2007/0029473 A1 * 2/2007 Verentchikov ..... H01J 49/406 250/281
2007/0187614 A1 8/2007 Schneider et al.
2007/0194223 A1 8/2007 Sato et al.
2008/0049402 A1 2/2008 Han et al.
2008/0197276 A1 8/2008 Nishiguchi et al.
2008/0290269 A1 11/2008 Saito et al.
2009/0272890 A1 11/2009 Ogawa et al.
2010/0072363 A1 3/2010 Giles et al.
2010/0140469 A1 6/2010 Nishiguchi
2010/0193682 A1 8/2010 Golikov
2010/0301202 A1 12/2010 Vestal
2011/0133073 A1 6/2011 Sato et al.
2011/0168880 A1 7/2011 Ristroph et al.
2011/0180705 A1 7/2011 Yamaguchi
2011/0186729 A1 8/2011 Verentchikov et al.
2012/0168618 A1 7/2012 Vestal
2013/0048852 A1 2/2013 Verenchikov
2013/0056627 A1 3/2013 Verenchikov
2013/0068942 A1 3/2013 Verentchikov
2013/0187044 A1 7/2013 Ding et al.
2013/0240725 A1 9/2013 Makarov
2013/0248702 A1 9/2013 Makarov
2013/0313424 A1 11/2013 Makarov
2013/0327935 A1 12/2013 Wiedenbeck
2014/0054456 A1 2/2014 Kinugawa et al.
2014/0084156 A1 3/2014 Ristroph
2014/0117226 A1 5/2014 Giannakopulos
2014/0138538 A1 5/2014 Hieftje et al.
2014/0183354 A1 7/2014 Moon et al.
2014/0239172 A1 8/2014 Makarov
2014/0291503 A1 10/2014 Shchepunov et al.
2014/0361162 A1 12/2014 Murray et al.
2015/0028197 A1 1/2015 Grinfeld et al.
2015/0028198 A1 1/2015 Grinfeld et al.
2015/0048245 A1 2/2015 Vestal et al.
2015/0122986 A1 5/2015 Haase
2015/0279650 A1 10/2015 Verenchikov
2015/0294849 A1 10/2015 Makarov et al.
2016/0079052 A1 3/2016 MAakarov
2016/0225598 A1 8/2016 Ristroph
2016/0225602 A1 8/2016 Ristroph et al.
2016/0240363 A1 8/2016 Verenchikov
2017/0025265 A1 1/2017 Verenchikov et al.
2017/0032952 A1 2/2017 Verenchikov

(56) References Cited

U.S. PATENT DOCUMENTS

| | | | |
|---|---|---|---|
| 2017/0098533 | A1 | 4/2017 | Stewart et al. |
| 2017/0338094 | A1 | 11/2017 | Verentchikov |

FOREIGN PATENT DOCUMENTS

| | | | | |
|---|---|---|---|---|
| DE | 10116536 | A | 10/2002 | |
| EP | D237259 | A2 | 9/1987 | |
| EP | 1137044 | A2 | 9/2001 | |
| EP | 2068346 | A2 | 6/2009 | |
| EP | 2599104 | A1 | 6/2013 | |
| GB | 2080021 | B | 11/1984 | |
| GB | 2217907 | A | 11/1989 | |
| GB | 2390935 | A | 1/2004 | |
| GB | 2403063 | A | 12/2004 | |
| GB | 2396742 | B | 12/2005 | |
| GB | 2455977 | A | 7/2009 | |
| GB | 2478300 | A | 9/2011 | |
| GB | 2489094 | A | 9/2012 | |
| GB | 2490571 | A | 11/2012 | |
| GB | 2495127 | A | 4/2013 | |
| GB | 2495221 | A | 4/2013 | |
| GB | 2496991 | A | 5/2013 | |
| GB | 2496994 | A | 5/2013 | |
| GB | 2501332 | A | 10/2013 | |
| GB | 2506362 | A | 4/2014 | |
| GB | 2528875 | A | 2/2016 | |
| GB | 2555609 | A | 5/2018 | |
| GB | 2556451 | A | 5/2018 | |
| JP | 2003031178 | A | 1/2003 | |
| JP | 3571546 | B2 | 9/2004 | |
| JP | 2005538346 | A | 12/2005 | |
| JP | 2006049273 | A | 2/2006 | |
| JP | 2007227042 | A | 9/2007 | |
| JP | 2010062152 | A | 3/2010 | |
| JP | 1649234 | B2 | 3/2011 | |
| JP | 2013539590 | A | 10/2013 | |
| JP | 2015506567 | A | 3/2015 | |
| RU | 2564443 | C2 | 10/2015 | |
| RU | 2015148627 | A | 5/2017 | |
| RU | 2660655 | C2 | 7/2018 | |
| SU | 1725289 | A1 | 4/1992 | |
| WO | 1998/001218 | A1 | 1/1998 | |
| WO | 1998001218 | A1 | 1/1998 | |
| WO | 2000/77823 | A2 | 12/2000 | |
| WO | 2005001878 | A2 | 1/2005 | |
| WO | 2006102430 | A2 | 9/2006 | |
| WO | 2007044696 | A1 | 4/2007 | |
| WO | 2007/104992 | A1 | 9/2007 | |
| WO | 2007/136373 | A1 | 11/2007 | |
| WO | 2010008386 | A1 | 1/2010 | |
| WO | 2011086430 | A1 | 7/2011 | |
| WO | WO-2011086430 | A1 * | 7/2011 | ..... H01J 49/4245 |
| WO | 2011107836 | A1 | 9/2011 | |
| WO | 2011135477 | A1 | 11/2011 | |
| WO | 2012/010894 | A1 | 1/2012 | |
| WO | 2012024468 | A2 | 2/2012 | |
| WO | 2012116765 | A1 | 9/2012 | |
| WO | 2013045428 | A1 | 4/2013 | |
| WO | 2013/063587 | A2 | 5/2013 | |
| WO | 2013063587 | A2 | 5/2013 | |
| WO | 2013093587 | A1 | 6/2013 | |
| WO | 2013098612 | A1 | 7/2013 | |
| WO | 2013110587 | A2 | 8/2013 | |
| WO | 2013110588 | A2 | 8/2013 | |
| WO | 2013124207 | A | 8/2013 | |
| WO | 2014/074822 | A1 | 5/2014 | |
| WO | 2014074822 | A1 | 5/2014 | |
| WO | 2014110697 | A1 | 7/2014 | |
| WO | 2014/142897 | A1 | 9/2014 | |
| WO | 2014142897 | A1 | 9/2014 | |
| WO | 2015/142897 | A1 | 9/2015 | |
| WO | 2015142897 | A1 | 9/2015 | |
| WO | 2015/153630 | A1 | 10/2015 | |
| WO | 2015152968 | A1 | 10/2015 | |
| WO | 2015153644 | A1 | 10/2015 | |
| WO | 2016064398 | A1 | 4/2016 | |
| WO | 2016174462 | A1 | 11/2016 | |
| WO | 2018/073589 | A1 | 4/2018 | |
| WO | 2019/030476 | A1 | 2/2019 | |

OTHER PUBLICATIONS

Search Report for United Kingdom Application No. GB1613988.3 dated Jan. 5, 2017, 4 pages.

Sakurai et al., "A New Multi-Passage Time-of-Flight Mass Spectrometer at JAIST", Nuclear Instruments & Methods in Physics Research, Section A, Elsevier, 427(1-2): 182-186, May 11, 1999.

Toyoda et al., "Multi-Turn-Time-of-Flight Mass Spectometers with Electrostatic Sectors", Journal of Mass Spectrometry, 38: 1125-1142, Jan. 1, 2003.

Wouters et al., "Optical Design of the TOFI (Time-of-Flight Isochronous) Spectrometer for Mass Measurements of Exotic Nuclei", Nuclear Instruments and Methods in Physics Research, Section A, 240(1): 77-90, Oct. 1, 1985.

Stresau, D., et al.: "Ion Counting Beyond 10ghz Using a New Detector and Conventional Electronics", European Winter Conference on Plasma Spectrochemistry, Feb. 4-8, 2001, Lillehammer, Norway, Retrieved from the Internet:URL:https://www.etp-ms.com/file-repository/21 [retrieved on Jul. 31, 2019].

Kaufmann, R., et. al., "Sequencing of peptides in a time-of-flight mass spectrometer: evaluation of postsource decay following matrix-assisted laser desorption ionisation (MALDI)", International Journal of Mass Spectrometry and Ion Processes, Elsevier Scientific Publishing CO. Amsterdam, NL, 131:355-385, Feb. 24, 1994.

Barry Shaulis et al: "Signal linearity of an extended range pulse counting detector: Applications to accurate and precise U-Pb dating of zircon by laser ablation quadrupole ICP-MS", G3: Geochemistry, Geophysics, Geosystems, 11(11):1-12, Nov. 20, 2010.

Search Report for United Kingdom Application No. GB1708430.2 dated Nov. 28, 2017.

International Search Report and Written Opinion for International Application No. PCT1GB20180051320 dated Aug. 1, 2018.

International Search Report and Written Opinion for International Application No. PCT/GB2019/051839 dated Sep. 18, 2019.

International Search Report and Written Opinion for International Application No. PCT/GB2019/051234 dated Jul. 29, 2019.

Combined Search and Examination Report for United Kingdom Application No. GB1901411.7 dated Jul. 31, 2019.

Examination Report for United Kingdom Application No. GB1618980.5 dated Jul. 25, 2019.

Extended European Search Report for EP Patent Application No. 16866997.6, dated Oct. 16, 2019.

Combined Search and Examination Report for GB 1906258.7, dated Oct. 25, 2019.

Combined Search and Examination Report for GB1906253.8, dated Oct. 30, 2019.

International Search Report and Written Opinion for International Application No. PCT/US2016/062174 dated Mar. 5, 2017.

Search Report for GB Application No. GB1520130.4 dated May 25, 2016.

Search Report Under Section 17(5) for Application No. GB1507363.8 dated Nov. 9, 2015.

Doroshenko, V.M., and Cotter, R.J., "Ideal velocity focusing in a reflectron time-of-flight mass spectrometer", American Society for Mass Spectrometry, 10(10):992-999 (1999).

IPRP PCT/US20161062174 dated May 22, 2018, 6 pages.

International Search Report and Written Opinion of the International Search Authority for Application No. PCT/GB2016/051238 dated Jul. 12, 2016, 16 pages.

International Search Report and Written Opinion for International Application No. PCTIUS2016/062203 dated Mar. 5, 2017, 8 pages.

Communication Relating to the Results of the Partial International Search for International Application No. PCT/GB2019/051118, dated Jul. 19, 2019, 25 pages.

Search Report for GB Application No. GB1520134.6 dated May 26, 2016.

IPRP PCT/US2016/062203, dated May 22, 2018, 6 pages.

(56) References Cited

OTHER PUBLICATIONS

IPRP for application PCT/GB2016/051238 dated Oct. 31, 2017, 13 pages.
International Search Report and Written Opinion for International Application No. PCT/US2016/063076 dated Mar. 30, 2017, 9 pages.
Search Report under Section 17(5) for application GB1707208.3, dated Oct. 12, 2017, 5 pages.
Search Report for GB Application No. 1520540.4 dated May 24, 2016.
IPRP for application PCT/US2016/063076, dated May 29, 2018, 7 pages.
Wikipedia, "Reflectron" , Oct. 9, 2015, Retrieved from the Internet: URL:https://en.wikipedia.org/w/index.php?t itle=Reflectron&oldid=684843442, [retrieved on May 29, 2019].
Scherer, S., et al., "A novel principle for an ion mirror design in time-of-flight mass spectrometry", International Journal of Mass Spectrometry, Elsevier Science Publishers, Amsterdam, NL, vol. 251, No. 1, Mar. 15, 2006.
International Search Report and Written Opinion for International Application No. PCT/EP2017/070508 dated Oct. 16, 2017, 18 pages.
IPRP PCT/GB17151981 dated Jan. 8, 2019, 7 pages.
International Search Report and Written Opinion for International Application No. PCT/GB2018/051206, dated Jul. 12, 2018, 9 pages.
N/a: " Electrostatic lens ," Wikipedia, Mar. 31, 2017 (Mar. 31, 2017), XP055518392, Retrieved from the Intemet:URL: https://en.wikipedia.org/w/index.phptitle=Electrostatic lens oldid=773161674[retrieved on Oct. 24, 2018].
Hussein, O.A. et al., "Study the most favorable shapes of electrostatic quadrupole doublet lenses" , AIP Conference Proceedings, vol. 1815, Feb. 17, 2017 (Feb. 17, 2017), p. 110003.
Supplementary Partial EP Search Report for EP Application No. 16866997.6, dated Jun. 7, 2019.
Yavor, M.I., et al., "High performance gridless ion mirrors for multi-reflection time-of-flight and electrostatic trap mass analyzers", International Journal of Mass Spectrometry, vol. 426, Mar. 2018, pp. 1-11.
Guan S., et al. "Stacked-ring electrostatic ion guide", Journal of the American Society for Mass Spectrometry, Elsevier Science Inc, 7(1)101-106 (1996).
International Search Report and Written Opinion for application No. PCT/GB2018/052104, dated Oct. 31, 2018, 14 pages.
International Search Report and Written Opinion for application No. PCT/GB2018/052105, dated Oct. 15, 2018, 18 pages.
International Search Report and Written Opinion for application PCT/GB2018/052100, dated Oct. 19, 2018, 19 pages.
International Search Report and Written Opinion for application PCT/GB2018/052102, dated Oct. 25, 2018, 14 pages.
International Search Report and Written Opinion for application No. PCT/GB2018/052103, dated Oct. 30, 2018, 16 pages.
International Search Report and Written Opinion for application No. PCT/GB2018/052101, dated Oct. 19, 2018, 15 pages.
Combined Search and Examination Report under Sections 17 and 18(3) for application GB1807605.9 dated Oct. 29, 2018, 5 pages.
Combined Search and Examination Report under Sections 17 and 18(3) for application GB18076265, dated Oct. 29, 2018, 7pages.
International Search Report and Written Opinion for application No. PCT/GB2018/052099, dated Oct. 10, 2018, 16 pages.
Kozlov, B. et al. "Enhanced Mass Accuracy in Multi-Reflecting TOF MS" www.waters.com/posters, ASMS Conference (2017).
Kozlov, B. et al. "Multiplexed Operation of an Orthogonal Multi-Reflecting TOF Instrument to Increase Duty Cycle by Two Orders" ASMS Conference, San Diego, CA, Jun. 6, 2018.
Kozlov, B. et al. "High accuracy self-calibration method for high resolution mass spectra" ASMS Conference Abstract, 2019.
Kozlov, B. et al. "Fast Ion Mobility Spectrometry and High Resolution TOF MS" ASMS Conference Poster (2014).
Verenchicov., A. N. "Parallel MS-MS Analysis in a Time-Flight Tandem. Problem Statement, Method, and Instrucmental Schemes" Institute for Analytical Instrucmentation RAS, Saint-Petersburg, (2004).
Yavor, M. I. "Planar Multireflection Time-Of-Flight Mass Analyser with Unlimited Mass Range" Institute for Analytical Instrucmentation RAS, Saint-Petersburg, (2004).
Khasin, Y. I. et al. "Initial Experimenatl Studies of a Planar Multireflection Time-Of-Flight Mass Spectrometer" Institute for Analytical Instrucmentation RAS, Saint-Petersburg, (2004).
Verenchicov., A. N. et al. "Stability of Ion Motion in Periodic Electrostatic Fields" Institute for Analytical Instrucmentation RAS, Saint-Petersburg, (2004).
Verenchicov., A. N. "The Concept of Mutireflecting Mass Spectrometer for Continuous Ion Sources" Institute for Analytical Instrucmentation RAS, Saint-Petersburg, (2006).
Verenchicov., A. N., et al. "Accurate Mass Measurements for Inerpreting Spectra of atmospheric Pressure Ionization" Institute for Analytical Instrucmentation RAS, Saint-Petersburg, (2006).
Kozlov, B. N. et al., "Experimental Studies of Space Charge Effects in Multireflecting Time-Of-Flight Mass Spectrometes" Institute for Analytical Instrucmentation RAS, Saint-Petersburg, (2006).
Kozlov, B. N. et al., "Multireflecting Time-Of-Flight Mass Spectrometer With an Ion Trap Source" Institute for Analytical Instrucmentation RAS, Saint-Petersburg, (2006).
Hasin, Y. I., et al., " Planar Time-Of-Flight Multireflecting Mass Spectrometer with an Orthogonal Ion Injection Out of Continuous Ion Sources" Institute for Analytical Instrucmentation RAS, Saint-Petersburg, (2006).
Lutvinsky Y. I. et al., "Estimation of Capacity of High Resolution Mass Spectra for Analysis of Complex Mixtures" Institute for Analytical Instrucmentation RAS, Saint-Petersburg, (2006).
Verenchicov., A. N. et al. "Accurate Mass Measurements for Interpreting Spectra of Atmospheric Pressure Ionization" Institute for Analytical Instrucmentation RAS, Saint-Petersburg, (2006).
Verenchicov., A. N. et al. "Multiplexing in Multi-Reflecting TOF MS" Journal of Applied Solution Chemistry and Modeling, 6:1-22 (2017).
Supplementary Partial EP Search Report for EP Application No. 16869126.9, dated Jun. 13, 2019.

* cited by examiner

ION MIRROR AND ION-OPTICAL LENS FOR IMAGING

CROSS-REFERENCE TO RELATED APPLICATION

This application claims priority from and the benefit of United Kingdom patent application No. 1520540.4 filed on 23 Nov. 2016. The entire contents of this application are incorporated herein by reference.

FIELD OF THE INVENTION

The present invention relates generally to mass spectrometers and in particular to multi reflecting time-of-flight mass spectrometers (MR-TOF-MS) and methods of their use.

BACKGROUND

A time-of-flight mass spectrometer is a widely used tool of analytical chemistry, characterized by high speed analysis of wide mass ranges. It has been recognized that multi-reflecting time-of-flight mass spectrometers (MR-TOF-MS) provide a substantial increase in resolving power due by reflecting the ions multiple times within the flight region so as to extend the flight path of the ions. Such an extension of the ion flight paths requires folding ion paths either by reflecting ions between ion mirrors or by deflecting ions in sector fields. MR-TOF-MS instruments that use ion mirrors provide an important advantage of larger energy and spatial acceptance due to high-order time-per-energy and time-per-spatial spread ion focusing.

FIG. 1 illustrates a known MR-TOF-MS instrument, e.g. as described in SU 1725289. The instrument comprises two two-dimensional ion mirrors 12 extended along a drift dimension (Z-direction) for reflecting ions, an orthogonal accelerator 13 for injecting ions into the device, and a detector 14 for detecting the ions. For clarity, throughout this entire text the planar MR-TOF-MS is described in the standard Cartesian coordinate system. That is, the X-axis corresponds to the direction of time-of-flight, i.e. the direction of ion reflections between the ion mirrors, the Z-axis corresponds to the drift direction of the ions, and the vertical Y-axis is orthogonal to both the X and Z axes.

Referring to FIG. 1, in use, ions are accelerated by accelerator 13 towards one of the ions mirrors 12 at an inclination angle $\alpha$ to the X-axis. The ions therefore have a velocity in the X-direction and also a drift velocity in the Z direction. The ions enter into a first of the ion mirrors 12 and are reflected back towards a second of the ion mirrors 12. The ions then enter the second mirror 12 and are reflected back to the first ion mirror 12. The first ion mirror then reflects the ions back to the second ion mirror 12. This continues and the ions are continually reflected between the two ion mirrors 12 as they drift along the device in the Z-direction until the ions impact upon detector 14. The ions therefore follow a substantially sinusoidal or zigzag (jigsaw) mean trajectory within the X-Z plane. The ions advance along the Z-direction for each mirror reflection with an incremental distance of $Z_R=C*\sin\alpha$, where C is the flight path per one ion mirror reflection. However, no ion focusing is provided in the drift Z-direction and so the ion packets diverge in the drift Z-direction. This drawback limits the duty cycle of the spectrometer, for example, to less than 0.5% at a mass resolving power of 100,000.

It is known, e.g. from WO 2005/001878, to provide a set of periodic lenses within the field-free region between the ion mirrors so as to prevent the ion beam diverging significantly in the Z-direction, thereby overcoming the above described problem. However, it has been discovered that the ion optical elements of the instrument, including the periodic lenses, limit the practical applications of the analyser.

It is desired to provide an improved spectrometer and an improved method of spectrometry.

SUMMARY

From a first aspect the present invention provides an ion mirror comprising:

an ion entrance electrode section at the ion entrance to the ion mirror;

an energy focussing electrode section for reflecting ions back along a longitudinal axis towards said ion entrance;

a spatial focussing electrode section arranged between the ion entrance electrode section and the energy focussing electrode section for spatially focussing the ions;

one or more DC voltage supply configured to apply different DC voltages to the ion entrance electrode section, the spatial focussing electrode section and the energy focussing electrode section, and to apply a DC potential to the ion entrance electrode section that is intermediate the DC potential applied to the spatial focussing electrode section and the DC potential applied to the energy focussing electrode section; and (i) at least one first transition electrode arranged between said ion entrance electrode section and said spatial focussing electrode section, wherein said one or more DC voltage supply is configured to apply a DC potential to said at least one first transition electrode that is intermediate the DC potential applied to the ion entrance electrode section and the DC potential applied to the spatial focussing electrode section; and/or (ii) at least one second transition electrode arranged between said energy focussing electrode section and said spatial focussing electrode section, wherein said one or more DC voltage supply is configured to apply a DC potential to said at least one second transition electrode that is intermediate the DC potential applied to the spatial focussing electrode section and the DC potential applied to the ion entrance electrode section.

The inventors of the present invention have recognised that conventional ion mirrors induce spatial and time-of-flight aberrations which deteriorate the quality of spatial and time-of-flight focusing. As the level of spatial aberrations of focusing elements is linked to the level of time-of-flight aberrations, both reduce the mass resolving power of a spectrometer. Furthermore, large spatial aberrations restrict the ability of the spectrometer to operate in a spatially imaging mode or in a mode where signals from multiple ion sources are mapped in parallel to an array of detectors.

The first and/or second transition electrodes of the present invention enable the axial electric potential profile along the longitudinal axis (X-dimension) of the ion mirror to vary more smoothly and progressively. This enables a reduction in the spatial distortions of the ion beams in a dimension orthogonal to the longitudinal axis (e.g. reduces spatial distortions in the Y-dimension), as compared to conventional ion mirrors.

The ion mirror according to the embodiments of the present invention may therefore provide lower spatial and time-of-flight aberrations, enabling the spectrometer incorporating the mirror to have an increased mass resolving power as well being capable of being operated in imaging and parallel detection modes.

WO 2014/074822 discloses an ion mirror arrangement having an ion entrance section, an energy focussing section for reflecting ions which is maintained at a voltage higher than the entrance section, and low voltage region between the entrance section and the energy focussing section. However, transition electrodes according to claim 1 are not provided. More specifically, WO'822 does not disclose any transition electrodes between the entrance section and the low voltage region. Also, there are no transition electrodes between the energy focussing section and the low voltage region, wherein the DC potential applied to the transition electrode is intermediate the DC potential applied to the low voltage region and the entrance section.

WO 2014/142897 discloses an arrangement comprising a planar lens, shield and ion mirror. An ion accelerating region and an ion reflecting region is arranged within the ion mirror. However, the ion mirror does not include the transition electrodes required by claim 1.

The ion mirror according to the embodiments of the present invention may be configured for a time of flight mass analyser.

The DC potential applied to the ion entrance electrode section is greater than the DC potential applied to the spatial focussing electrode section and less than the DC potential applied to the energy focussing electrode section.

Ions enter the ion mirror along the longitudinal axis of the ion mirror (in the X-dimension) and are reflected back along that axis. The ion entrance electrode section, the spatial focussing electrode section and the energy focussing electrode section are longitudinal sections of the ion mirror spaced apart along the longitudinal axis.

The ion entrance electrode section may comprise one or more electrodes and said DC voltage supply may be configured to apply only a single potential, or the same potential, to the electrode(s) of the ion entrance electrode section; optionally such that the ion entrance electrode section is substantially a field-free region.

Alternatively, or additionally, an electrode of the ion entrance electrode section may extend continuously over the entire length of the ion entrance electrode section.

Optionally, at least 80%, at least 90% or at least 95% of the axial length of the ion entrance section is an electric field-free region.

All of the electrodes in the energy focussing electrode section may be maintained at a DC potential (or different DC potentials) that are at or above the DC potential(s) applied to the entrance electrode section. For example, an electrode at an entrance to the energy focussing electrode section may be maintained at the same DC potential as the DC potential applied to the entrance electrode section, and all other electrodes in the energy focussing electrode section may be maintained at a DC potential (or different DC potentials) that are above the DC potential applied to the entrance electrode section.

The DC voltage supply may be configured to apply multiple different DC potentials to different electrodes of the energy focussing electrode section for reflecting ions back along the longitudinal axis towards said ion entrance. The DC voltage supply may be configured to apply a DC potential to the ion entrance electrode section that is intermediate the DC potential applied to the spatial focussing electrode section and the lowest DC potential applied to the energy focussing electrode section.

Alternatively or additionally, although less desirably, the DC voltage supply may be configured to apply multiple different DC voltages to different electrodes of the spatial focussing electrode section. In this configuration, the DC voltage supply may be configured to apply a DC potential to the ion entrance electrode section that is intermediate the highest DC potential applied to the spatial focussing electrode section and the lowest DC potential applied to the energy focussing electrode section.

The ions mirror may have a length X along the longitudinal axis in a first dimension, a width Y in a second dimension orthogonal to said first dimension, and a drift length Z in a dimension orthogonal to both the first and second dimensions. The drift length Z may be greater than length X and/or width Y. Additionally, or alternatively, length X may be greater than width Y.

The ion entrance electrode section may have a length along the longitudinal axis (X-dimension) selected from the group consisting of: ≥5 mm; ≥10 mm; ≥15 mm; ≥20 mm; ≥25 mm; ≥30 mm; ≥40 mm; ≥50 mm; ≥60 mm; ≥70 mm; ≥80 mm; ≥90 mm; ≥100 mm; ≥110 mm; ≥120 mm; ≥130 mm; ≥140 mm; and ≥150 mm; and/or a length along the longitudinal axis (X-dimension) selected from the group consisting of: ≤5 mm; ≤10 mm; ≤15 mm; ≤20 mm; ≤25 mm; ≤30 mm; ≤40 mm; ≤50 mm; ≤60 mm; ≤70 mm; ≤80 mm; ≤90 mm; ≤100 mm; ≤110 mm; ≤120 mm; ≤130 mm; ≤140 mm; and ≤150 mm.

The spatial focussing electrode section may focus ions in a dimension (Y-dimension) that is orthogonal to said longitudinal axis (X-dimension).

The spatial focussing electrode section comprises one or more electrodes and said DC voltage supply may be configured to apply only a single potential, or the same potential, to the electrode(s) of the spatial focussing electrode section; and/or an electrode of the spatial focusing electrode section may extend continuously over the entire length of the spatial focussing electrode section.

The spatial focussing electrode section may have a length along the longitudinal axis (X-dimension) selected from the group consisting of: ≤100 mm; ≤90 mm; ≤80 mm; ≤70 mm; ≤60 mm; ≤50 mm; ≤40 mm; ≤30 mm; ≤20 mm; and/or ≥20 mm; ≥25 mm; ≥30 mm; ≥35 mm; ≥40 mm; ≥45 mm; ≥50 mm; ≥55 mm; and ≥60 mm.

The energy focussing electrode section may comprise at least two electrodes at different positions along the longitudinal axis, wherein the DC voltage supply is configured to apply a different potential to each of the at least two electrodes so as to provide an electric potential profile along the energy focussing electrode section for reflecting ions along the longitudinal axis towards said ion entrance.

Alternatively, or additionally, the energy focussing electrode section may comprise one or more electrodes having a resistive coating that varies in a direction along the longitudinal axis, and/or that is arranged at an angle to the longitudinal axis, such that when the voltage supply applies a voltage to the one or more electrodes an electric potential profile is arranged along the energy focussing electrode section that reflects ions along the longitudinal axis towards said entrance.

The energy focussing electrode section may have a length along the longitudinal axis (X-dimension) selected from the group consisting of: ≤100 mm; ≤90 mm; ≤80 mm; ≤70 mm; ≤60 mm; ≤50 mm; ≤40 mm; ≤30 mm; ≤20 mm; and/or ≥20 mm; ≥30 mm; ≥40 mm; ≥50 mm; ≥60 mm; ≥70 mm; ≥80 mm; ≥90 mm; ≥ and 100 mm.

Said at least one first transition electrode may comprise ≥m first transition electrodes arranged at different positions along the longitudinal axis, wherein m is selected from the group comprising: 2; 3; 4; 5; 6; 7; 8; 9; and 10.

The voltage supply may be configured to apply a different DC potential to each of the m first transition electrodes so as to provide an electric potential profile that progressively increases in a direction along said longitudinal axis from the spatial focussing section to the ion entrance section. The electric potential profile may progressively increase, without decreasing, in the direction along the longitudinal axis from the spatial focussing section to the ion entrance section.

The DC voltage supply is configured to apply at least one DC potential to said at least one first transition electrode. Where more than one first transition electrode is provided and these transition electrodes are maintained at different DC voltages, all of these DC voltages may be at values intermediate the (lowest) DC potential applied to the ion entrance electrode section and the (highest) DC potential applied to the spatial focussing electrode section.

The at least one first transition electrode may extend, or be arranged, over a length along the longitudinal axis (X-dimension) selected from the group consisting of: ≤100 mm; ≤90 mm; ≤80 mm; ≤70 mm; ≤60 mm; ≤50 mm; ≤40 mm; ≤30 mm; ≤20 mm; and/or ≥5 mm; ≥10 mm; ≥15 mm; ≥20 mm; ≥25 mm; ≥30 mm; ≥40 mm; ≥50 mm; ≥60 mm; ≥70 mm; ≥80 mm; ≥90 mm; ≥ and 100 mm.

Alternatively, or additionally, the at least one first transition electrode may comprise one or more electrodes having a resistive coating that varies in a direction along the longitudinal axis, and/or that is arranged at an angle to the longitudinal axis, such that when the voltage supply applies a voltage to the at least one first transition electrode so as to provide an electric potential profile that progressively increases in a direction along said longitudinal axis from the spatial focussing section to the ion entrance section.

Said at least one second transition electrode comprises ≥n second transition electrodes arranged at different positions along the longitudinal axis, wherein n is selected from the group comprising: 2; 3; 4; 5; 6; 7; 8; 9; and 10.

Fewer second transition electrodes may be provided than first transition electrodes.

The voltage supply may be configured to apply a different DC potential to each of the n second transition electrodes so as to provide an electric potential profile that progressively increases in a direction along said longitudinal axis from the spatial focussing section to the energy focussing electrode section. The electric potential profile may progressively increase, without decreasing, in the direction along the longitudinal axis from the spatial focussing section to the energy focussing section.

The DC voltage supply is configured to apply a DC potential to said at least one second transition electrode. Where more than one second transition electrode is provided and these transition electrodes are maintained at different DC voltages, all of these DC voltages may be at values intermediate the (highest) DC potential applied to the spatial focussing electrode section and the (lowest) DC voltage applied to the ion entrance electrode section.

The at least one second transition electrode may extend, or be arranged, over a length along the longitudinal axis (X-dimension) selected from the group consisting of: ≤100 mm; ≤90 mm; ≤80 mm; ≤70 mm; ≤60 mm; ≤50 mm; ≤40 mm; ≤30 mm; ≤20 mm; and/or ≥5 mm; ≥10 mm; ≥15 mm; ≥20 mm; ≥25 mm; ≥30 mm; ≥40 mm; ≥50 mm; ≥60 mm; ≥70 mm; ≥80 mm; ≥90 mm; ≥ and 100 mm.

The at least one second transition electrode may extend, or be arranged, over a shorter length along the longitudinal axis (X-dimension) than the at least one first transition electrode.

The ion entrance section may have an internal width in a dimension (Y-dimension) orthogonal to the longitudinal axis selected from the group consisting of: ≥20 mm; ≥25 mm; ≥30 mm; ≥35 mm; ≥40 mm; ≥45 mm; ≥50 mm; ≥55 mm; and ≥60 mm.

The spatial focussing electrode section may have an internal width in a dimension (Y-dimension) orthogonal to the longitudinal axis selected from the group consisting of: ≥20 mm; ≥25 mm; ≥30 mm; ≥35 mm; ≥40 mm; ≥45 mm; ≥50 mm; ≥55 mm; and ≥60 mm.

The energy focussing electrode section may have an internal width in a dimension (Y-dimension) orthogonal to the longitudinal axis selected from the group consisting of: ≥20 mm; ≥25 mm; ≥30 mm; ≥40 mm; ≥50 mm; and ≥60 mm.

The at least one first transition electrode nay have an internal width in a dimension (Y-dimension) orthogonal to the longitudinal axis selected from the group consisting of: ≥20 mm; ≥25 mm; ≥30 mm; ≥40 mm; ≥50 mm; and ≥60 mm.

The at least one second transition electrode may have an internal width in a dimension (Y-dimension) orthogonal to the longitudinal axis selected from the group consisting of: ≥20 mm; ≥25 mm; ≥30 mm; ≥40 mm; ≥50 mm; and ≥60 mm.

The spatial focussing section, first transition electrodes and ion entrance electrode section provide a smooth potential profile spanning these sections.

The spatial focussing electrode section, second transition electrodes and energy focussing electrode section provide a smooth potential profile spanning these sections.

The potential profile provided by the first transition electrodes, spatial focussing electrode section and second transition electrodes may be a substantially quadratic potential.

The relative magnitudes of the DC potentials described herein may be with reference to the potentials experienced by the ions. For example, ion of both polarities will be urged away from a high DC potential towards a lower DC potential (whereas ions of both polarities would not be urged away from a more positive DC voltage to a less positive voltage).

From a second aspect the present invention provides an ion mirror comprising:

an ion entrance electrode section at the ion entrance to the ion mirror;

an energy focussing electrode section for reflecting ions back along a longitudinal axis towards said ion entrance;

a spatial focussing electrode section arranged between the ion entrance electrode section and the energy focussing electrode section for spatially focussing the ions;

one or more DC voltage supply configured to apply different DC voltages to the ion entrance electrode section, the spatial focussing electrode section and the energy focussing electrode section, and to apply a DC potential to the spatial focussing electrode section that is intermediate the DC potential applied to the ion entrance electrode section and a DC potential applied to the energy focussing electrode section; and (i) at least one first transition electrode arranged between said ion entrance electrode section and said spatial focussing electrode section, wherein said one or more DC voltage supply is configured to apply a DC potential to said at least one first transition electrode that is intermediate the DC potential applied to the ion entrance electrode section and the DC potential applied to the spatial focussing electrode section; and/or (ii) at least one second transition electrode arranged between said energy focussing electrode section and said spatial focussing electrode section, wherein said one or more DC voltage supply is configured to apply a DC potential to said at least one second transition electrode that is below the DC potential applied to the spatial focussing electrode section.

This arrangement provides the ion mirror with a potential profile that initially decelerates the ions along the longitudinal axis (X-dimension) of the ion mirror as the ions enter the spatial focussing electrode section. The ions may be accelerated out of the spatial focussing electrode section and into the energy focussing electrode section by the potential profile.

The first and/or second transition electrodes enables the axial electric potential profile along the longitudinal axis (X-dimension) of the ion mirror to vary more smoothly and progressively. This enables a reduction in the spatial distortions of the ion beams in a dimension orthogonal to the longitudinal axis (e.g. reduces spatial distortions in the Y-dimension), as compared to conventional ion mirrors.

The ion mirror may be configured for a time of flight mass analyser.

Ions enter the ion mirror along the longitudinal axis of the ion mirror (in the X-dimension) and are reflected back along that axis. The ion entrance electrode section, the spatial focussing electrode section and the energy focussing electrode section are longitudinal sections of the ion mirror spaced apart along the longitudinal axis.

The ion entrance electrode section may comprises one or more electrodes and said DC voltage supply may be configured to apply only a single potential, or the same potential, to the electrode(s) of the ion entrance electrode section; optionally such that the ion entrance electrode section is substantially a field-free region.

An electrode of the ion entrance electrode section may extend continuously over the entire length of the ion entrance electrode section.

Optionally, at least 80%, at least 90% or at least 95% of the axial length of the ion entrance section is an electric field-free region.

The DC voltage supply may be configured to apply multiple different DC potentials to different electrodes of the energy focussing electrode section for reflecting ions back along the longitudinal axis towards said ion entrance; and the DC voltage supply may be configured to apply a DC potential to the ion entrance electrode section that is below the DC potential applied to the spatial focussing electrode section and at or below the lowest DC potential applied to the energy focussing electrode section.

The ion mirror may have a length X along the longitudinal axis in a first dimension, a width Y in a second dimension orthogonal to said first dimension, and a drift length Z in a dimension orthogonal to both the first and second dimensions. The drift length Z may be greater than length X and/or width Y. Additionally, or alternatively, length X may be greater than width Y.

The ion entrance electrode section may have a length along the longitudinal axis (X-dimension) selected from the group consisting of: ≥30 mm; ≥40 mm; ≥50 mm; ≥60 mm; ≥70 mm; ≥80 mm; ≥90 mm; ≥100 mm; ≥110 mm; ≥120 mm; ≥130 mm; ≥140 mm; and ≥150 mm.

The spatial focussing electrode section may focus ions in a dimension (Y-dimension) that is orthogonal to said longitudinal axis (X-dimension).

The spatial focussing electrode section may comprise one or more electrodes and said DC voltage supply may be configured to apply only a single potential, or the same potential, to the electrode(s) of the spatial focussing electrode section; and/or an electrode of the spatial focusing electrode section may extend continuously over the entire length of the spatial focussing electrode section.

The spatial focussing electrode section may have a length along the longitudinal axis (X-dimension) selected from the group consisting of: ≤100 mm; ≤90 mm; ≤80 mm; ≤70 mm; ≤60 mm; ≤50 mm; ≤40 mm; ≤30 mm; ≤20 mm; and/or ≥20 mm; ≥25 mm; ≥30 mm; ≥35 mm; ≥40 mm; ≥45 mm; ≥50 mm; ≥55 mm; and ≥60 mm.

The energy focussing electrode section may comprise at least two electrodes at different positions along the longitudinal axis, wherein the DC voltage supply is configured to apply a different potential to each of the at least two electrodes so as to provide an electric potential profile along the energy focussing electrode section for reflecting ions along the longitudinal axis towards said ion entrance.

Alternatively, or additionally, the energy focussing electrode section may comprise one or more electrodes having a resistive coating that varies in a direction along the longitudinal axis, and/or that is arranged at an angle to the longitudinal axis, such that when the voltage supply applies a voltage to the one or more electrodes an electric potential profile is arranged along the energy focussing electrode section that reflects ions along the longitudinal axis towards said entrance.

The energy focussing electrode section may have a length along the longitudinal axis (X-dimension) selected from the group consisting of: ≤100 mm; ≤90 mm; ≤80 mm; ≤70 mm; ≤60 mm; ≤50 mm; ≤40 mm; ≤30 mm; ≤20 mm; and/or ≥20 mm; ≥30 mm; ≥40 mm; ≥50 mm; ≥60 mm; ≥70 mm; ≥80 mm; ≥90 mm; ≥ and 100 mm.

Said at least one first transition electrode may comprise ≥m first transition electrodes arranged at different positions along the longitudinal axis, wherein ≥m is selected from the group comprising: 2; 3; 4; 5; 6; 7; 8; 9; and 10.

The voltage supply may be configured to apply a different DC potential to each of the m first transition electrodes so as to provide an electric potential profile that progressively increases in a direction along said longitudinal axis from the ion entrance electrode section to the spatial focussing electrode section.

The electric potential profile may progressively increase, without decreasing, in the direction along the longitudinal axis from the ion entrance section to the spatial focussing section.

The DC voltage supply is configured to apply at least one DC potential to said at least one first transition electrode. Where more than one first transition electrode is provided and these transition electrodes are maintained at different DC voltages, all of these DC voltages may be at values intermediate the (highest) DC potential applied to the ion entrance electrode section and the (lowest) DC potential applied to the spatial focussing electrode section.

The at least one first transition electrode may extend, or be arranged, over a length along the longitudinal axis (X-dimension) selected from the group consisting of: ≤100 mm; ≤90 mm; ≤80 mm; ≤70 mm; ≤60 mm; ≤50 mm; ≤40 mm; ≤30 mm; ≤20 mm; and/or ≥5 mm; ≥10 mm; ≥15 mm; ≥20 mm; ≥25 mm; ≥30 mm; ≥40 mm; ≥50 mm; ≥60 mm; ≥70 mm; ≥80 mm; ≥90 mm; ≥ and 100 mm.

Alternatively, or additionally, the at least one first transition electrode may comprise one or more electrodes having a resistive coating that varies in a direction along the longitudinal axis, and/or that is arranged at an angle to the longitudinal axis, such that when the voltage supply applies a voltage to the at least one first transition electrode so as to provide an electric potential profile that progressively increases in a direction along said longitudinal axis from the ion entrance section to the spatial focussing section.

Said at least one second transition electrode may comprise ≥n second transition electrodes arranged at different positions along the longitudinal axis, wherein n is selected from the group comprising: 2; 3; 4; 5; 6; 7; 8; 9; and 10.

Fewer second transition electrodes may be provided than first transition electrodes.

The voltage supply may be configured to apply a different DC potential to each of the n second transition electrodes so as to provide an electric potential profile that progressively decreases in a direction along said longitudinal axis from the spatial focussing section to the energy focussing electrode section. The electric potential profile may progressively decrease, without increasing, in the direction along the longitudinal axis from the spatial focussing section to the energy focussing section.

The DC voltage supply is configured to apply a DC potential to said at least one second transition electrode. Where more than one second transition electrode is provided and these transition electrodes are maintained at different DC voltages, all of these DC voltages may be at values intermediate the (highest) DC potential applied to the spatial focussing electrode section and the (lowest) DC voltage applied to the energy focussing electrode section.

The at least one second transition electrode may extend, or be arranged, over a length along the longitudinal axis (X-dimension) selected from the group consisting of: ≤100 mm; ≤90 mm; ≤80 mm; ≤70 mm; ≤60 mm; ≤50 mm; ≤40 mm; ≤30 mm; ≤20 mm; and/or ≥5 mm; ≥10 mm; ≥15 mm; ≥20 mm; ≥25 mm; ≥30 mm; ≥40 mm; ≥50 mm; ≥60 mm; ≥70 mm; ≥80 mm; ≥90 mm; ≥ and 100 mm.

The at least one second transition electrode may extend, or be arranged, over a shorter length along the longitudinal axis (X-dimension) than the at least one first transition electrode.

The ion entrance section may have an internal width in a dimension (Y-dimension) orthogonal to the longitudinal axis selected from the group consisting of: ≥20 mm; ≥25 mm; ≥30 mm; ≥35 mm; ≥40 mm; ≥45 mm; ≥50 mm; ≥55 mm; and ≥60 mm.

The spatial focussing electrode section may have an internal width in a dimension (Y-dimension) orthogonal to the longitudinal axis selected from the group consisting of: ≥20 mm; ≥25 mm; ≥30 mm; ≥35 mm; ≥40 mm; ≥45 mm; ≥50 mm; ≥55 mm; and ≥60 mm.

The energy focussing electrode section may have an internal width in a dimension (Y-dimension) orthogonal to the longitudinal axis selected from the group consisting of: ≥20 mm; ≥25 mm; ≥30 mm; ≥40 mm; ≥50 mm; and ≥60 mm.

The at least one first transition electrode may have an internal width in a dimension (Y-dimension) orthogonal to the longitudinal axis selected from the group consisting of: ≥20 mm; ≥25 mm; ≥30 mm; ≥40 mm; ≥50 mm; and ≥60 mm.

The at least one second transition electrode may have an internal width in a dimension (Y-dimension) orthogonal to the longitudinal axis selected from the group consisting of: ≥20 mm; ≥25 mm; ≥30 mm; ≥40 mm; ≥50 mm; and ≥60 mm.

The spatial focussing section, first transition electrodes and ion entrance electrode section provide a smooth potential profile spanning these sections.

The spatial focussing electrode section, second transition electrodes and energy focussing electrode section provide a smooth potential profile spanning these sections.

The present invention also provides a mass spectrometer comprising an ion mirror as described above; or comprising two ion mirrors, each of the type described above, wherein the spectrometer is configured such that, in use, ions are reflected between the two ion mirrors.

The spectrometer may be a time of flight mass spectrometer.

From a third aspect the present invention provides a time of flight mass spectrometer comprising:

a time of flight region for separating ions according to their mass to charge ratio; and an ion optical lens for spatially focussing ions arranged within the time of flight region, said lens comprising:

an ion entrance electrode section and an ion exit electrode section at opposite ends of the lens, and a spatial focussing electrode section arranged between the ion entrance and ion exit electrode sections for spatially focussing ions passing through the lens;

one or more DC voltage supply configured to apply DC voltages to the ion entrance electrode section, the spatial focussing electrode section and the ion exit electrode section; and to apply a DC potential to the spatial focussing electrode section that is either lower or greater than both the DC potential applied to the ion entrance electrode section and the DC potential applied to the ion exit electrode section; and (i) at least one first transition electrode arranged between said ion entrance electrode section and said spatial focussing electrode section, wherein said one or more DC voltage supply is configured to apply a DC potential to said at least one first transition electrode that is intermediate the DC potential applied to the ion entrance electrode section and the DC potential applied to the spatial focussing electrode section; and/or (ii) at least one second transition electrode arranged between said ion exit electrode section and said spatial focussing electrode section, wherein said one or more DC voltage supply is configured to apply a DC potential to said at least one second transition electrode that is intermediate the DC potential applied to the ion exit electrode section and the DC potential applied to the spatial focussing electrode section.

The inventors of the present invention have recognised that conventional ion optical lenses induce spatial and time-of-flight aberrations which deteriorate the quality of spatial and time-of-flight focusing. As the level of spatial aberrations of focusing elements is linked to the level of time-of-flight aberrations, both reduce the mass resolving power of a spectrometer. Furthermore, large spatial aberrations restrict the ability of the spectrometer to operate in a spatially imaging mode or in a mode where signals from multiple ion sources are mapped in parallel to an array of detectors.

The first and/or second transition electrodes of the present invention enable the axial electric potential profile along the longitudinal axis (X-dimension) of the ion lens to vary more smoothly and progressively. This enables a reduction in the spatial distortions of the ion beams in a dimension orthogonal to the longitudinal axis (e.g. reduces spatial distortions in the Z-dimension), as compared to conventional ion lenses.

The ion lens of the embodiments of the present invention may therefore provide lower spatial and time-of-flight aberrations, enabling the spectrometer to have an increased mass resolving power as well being capable of being operated in imaging and parallel detection modes.

The DC potential applied to the spatial focussing electrode section may be a voltage that is greater or lower than the voltage(s) applied to the ion entrance and exit electrode sections.

The lens may have a longitudinal axis. The ion entrance electrode section, spatial focussing electrode section and ion exit electrode section may be arranged sequentially along said longitudinal axis.

The lens may be formed from multiple pairs of opposing electrodes. Optionally, each electrode is a planar electrode.

The spatial focusing electrode section may focus the ions in a dimension (Z-dimension) perpendicular to the longitudinal axis (X-dimension).

The spectrometer may be configured such that ions enter, pass through and exit the lens with a component of velocity along the longitudinal axis (X-dimension) of the lens; and such that the ions enter, pass through and exit the lens with a component of velocity in the dimension (Z-dimension) perpendicular to the longitudinal axis (X-dimension).

The lens may be an einzel lens.

The spectrometer may be configured such that ions enter and exit the ion lens with substantially the same kinetic energy.

The ion entrance electrode section may comprise one or more electrodes and said DC voltage supply may be configured to apply only a single potential, or the same potential, to the electrode(s) of the ion entrance electrode section; optionally such that the ion entrance electrode section is substantially a field-free region.

An electrode of the ion entrance electrode section may extend continuously over the entire length of the ion entrance electrode section.

Optionally, at least 80%, at least 90% or at least 95% of the axial length of the ion entrance section is an electric field-free region.

The ion exit electrode section may comprise one or more electrodes and said DC voltage supply may be configured to apply only a single potential, or the same potential, to the electrode(s) of the ion exit electrode section; optionally such that the ion exit electrode section is substantially a field-free region.

An electrode of the ion exit electrode section may extend continuously over the entire length of the ion exit electrode section.

Optionally, at least 80%, at least 90% or at least 95% of the axial length of the ion exit section is an electric field-free region.

The ion lens may have a length X along the longitudinal axis in a first dimension, a width Y in a second dimension orthogonal to said first dimension, and a drift length Z in a dimension orthogonal to both the first and second dimensions. The drift length Z may be greater than length X and/or width Y. Additionally, or alternatively, length X may be greater than width Y.

The ion entrance electrode section and/or ion exit electrode section of the lens has a length along the longitudinal axis (X-dimension) selected from the group consisting of: ≥30 mm; ≥40 mm; ≥50 mm; ≥60 mm; ≥70 mm; ≥80 mm; ≥90 mm; ≥100 mm; ≥110 mm; ≥120 mm; ≥130 mm; ≥140 mm; ≥150 mm; ≥160 mm; ≥170 mm; ≥180 mm; ≥190 mm; and ≥200 mm.

The spatial focussing electrode section focuses ions in a dimension (Y-dimension) that is orthogonal to said longitudinal axis (X-dimension).

The spatial focussing electrode section may comprise one or more electrodes and said DC voltage supply may be configured to apply only a single potential, or the same potential, to the electrode(s) of the spatial focussing electrode section; and/or an electrode of the spatial focusing electrode section may extend continuously over the entire length of the spatial focussing electrode section.

The spatial focussing electrode section may have a length along the longitudinal axis (X-dimension) selected from the group consisting of: ≥20 mm; ≥25 mm; ≥30 mm; ≥35 mm; ≥40 mm; ≥45 mm; ≥50 mm; ≥55 mm; ≥60 mm; ≥70 mm; ≥80 mm; ≥90 mm; and ≥100 mm; and/or ≤100 mm; ≤90 mm; ≤80 mm; ≤70 mm; ≤60 mm; ≤50 mm; ≤40 mm; and ≤30 mm.

Said at least one first transition electrode comprises ≥p first transition electrodes arranged at different positions along the longitudinal axis, wherein p is selected from the group comprising: 2; 3; 4; 5; 6; 7; 8; 9; and 10.

Said at least one second transition electrode comprises ≥q second transition electrodes arranged at different positions along the longitudinal axis, wherein q is selected from the group comprising: 2; 3; 4; 5; 6; 7; 8; 9; and 10.

The voltage supply may be configured to apply a different DC potential to each of the p first transition electrodes so as to provide an electric potential profile that either progressively decreases in a direction along said longitudinal axis from the ion entrance electrode section to the spatial focussing section, and wherein the voltage supply is configured to apply a different DC potential to each of the q second transition electrodes so as to provide an electric potential profile that either progressively decreases in a direction along said longitudinal axis from the ion exit electrode section to the spatial focussing section.

The electric potential profile may progressively decrease, without increasing, in the direction along the longitudinal axis from the ion entrance electrode section to the spatial focussing section.

The electric potential profile may progressively decrease, without increasing, in the direction along the longitudinal axis from the ion exit electrode section to the spatial focussing section.

Alternatively, the voltage supply may be configured to apply a different DC potential to each of the p first transition electrodes so as to provide an electric potential profile that progressively increases in a direction along said longitudinal axis from the ion entrance electrode section to the spatial focussing section, and wherein the voltage supply is configured to apply a different DC potential to each of the q second transition electrodes so as to provide an electric potential profile that progressively increases in a direction along said longitudinal axis from the ion exit electrode section to the spatial focussing section.

The electric potential profile may progressively increase, without decreasing, in the direction along the longitudinal axis from the ion entrance electrode section to the spatial focussing section.

The electric potential profile may progressively increase, without decreasing, in the direction along the longitudinal axis from the ion exit electrode section to the spatial focussing section.

The DC voltage supply is configured to apply at least one DC potential to said at least one first transition electrode. Where more than one first transition electrode is provided and these transition electrodes are maintained at different DC voltages, all of these DC voltages may be at values intermediate the DC potential applied to the ion entrance electrode section and the DC potential applied to the spatial focussing electrode section.

Similarly, the DC voltage supply is configured to apply at least one DC potential to said at least one second transition electrode. Where more than one second transition electrode is provided and these transition electrodes are maintained at different DC voltages, all of these DC voltages may be at values intermediate the DC potential applied to the ion exit electrode section and the DC potential applied to the spatial focussing electrode section.

The at least one first transition electrode may extend, or be arranged, over a length along the longitudinal axis (X-dimension) selected from the group consisting of: ≤100 mm; ≤90 mm; ≤80 mm; ≤70 mm; ≤60 mm; ≤50 mm; ≤40 mm; ≤30 mm; ≤20 mm; and/or ≤5 mm; ≥10 mm; ≥15 mm; ≥20 mm; ≥25 mm; ≥30 mm; ≥40 mm; ≥50 mm; ≥60 mm; ≥70 mm; ≥80 mm; ≥90 mm; ≥ and 100 mm.

The at least one second transition electrode may extend, or be arranged, over a length along the longitudinal axis (X-dimension) selected from the group consisting of: ≤100 mm; ≤90 mm; ≤80 mm; ≤70 mm; ≤60 mm; ≤50 mm; ≤40 mm; ≤30 mm; ≤20 mm; and/or ≥5 mm; ≥10 mm; ≥15 mm; ≥20 mm; ≥25 mm; ≥30 mm; ≥40 mm; ≥50 mm; ≥60 mm; ≥70 mm; ≥80 mm; ≥90 mm; ≥ and 100 mm.

Alternatively, or additionally, the at least one first transition electrode may comprise one or more electrodes having a resistive coating that varies in a direction along the longitudinal axis, and/or that is arranged at an angle to the longitudinal axis, such that when the voltage supply applies a voltage to the at least one first transition electrode so as to provide an electric potential profile that progressively decreases or increases in a direction along said longitudinal axis from the spatial focussing section to the ion entrance section.

Similarly, the at least one second transition electrode may comprise one or more electrodes having a resistive coating that varies in a direction along the longitudinal axis, and/or that is arranged at an angle to the longitudinal axis, such that when the voltage supply applies a voltage to the at least one second transition electrode so as to provide an electric potential profile that progressively decreases or increases in a direction along said longitudinal axis from the spatial focussing section to the ion entrance section.

The ion lens may have a length along the longitudinal axis (X-dimension) selected from the group consisting of: ≥75 mm; ≥80 mm; ≥85 mm; ≥90 mm; ≥95 mm; ≥100 mm; ≥110 mm; ≥120 mm; ≥130 mm; ≥140 mm; ≥150 mm; ≥160 mm; ≥170 mm; ≥180 mm; ≥190 mm; ≥200 mm; ≥220 mm; ≥240 mm; ≥260 mm; ≥280 mm; ≥300 mm; ≥320 mm; ≥340 mm; ≥360 mm; ≥380 mm; and ≥400 mm; and/or ≤400 mm; ≤380 mm; ≤360 mm; ≤340 mm; ≤320 mm; ≤300 mm; ≤280 mm; ≤260 mm; ≤240 mm; ≤220 mm; ≤200 mm; ≤190 mm; ≤180 mm; ≤170 mm; ≤160 mm; ≤150 mm; ≤140 mm; ≤130 mm; ≤120 mm; ≤110 mm; and ≤100 mm.

The ion entrance section may have an internal width in a dimension (Y-dimension) orthogonal to the longitudinal axis selected from the group consisting of: ≥20 mm; ≥25 mm; ≥30 mm; ≥35 mm; ≥40 mm; ≥45 mm; ≥50 mm; ≥55 mm; and ≥60 mm.

The spatial focussing electrode section may have an internal width in a dimension (Y-dimension) orthogonal to the longitudinal axis selected from the group consisting of: ≥20 mm; ≥25 mm; ≥30 mm; ≥35 mm; ≥40 mm; ≥45 mm; ≥50 mm; ≥55 mm; and ≥60 mm.

The ion exit section may have an internal width in a dimension (Y-dimension) orthogonal to the longitudinal axis selected from the group consisting of: ≥20 mm; ≥25 mm; ≥30 mm; ≥35 mm; ≥40 mm; ≥45 mm; ≥50 mm; ≥55 mm; and ≥60 mm.

The at least one first transition electrode may have an internal width in a dimension (Y-dimension) orthogonal to the longitudinal axis selected from the group consisting of: ≥20 mm; ≥25 mm; ≥30 mm; ≥40 mm; ≥50 mm; and ≥60 mm.

The at least one second transition electrode may have an internal width in a dimension (Y-dimension) orthogonal to the longitudinal axis selected from the group consisting of: ≥20 mm; ≥25 mm; ≥30 mm; ≥40 mm; ≥50 mm; and ≥60 mm.

The spatial focussing section, first transition electrodes and ion entrance electrode section provide a smooth potential profile spanning these sections.

The spatial focussing electrode section, second transition electrodes and ion exit electrode section provide a smooth potential profile spanning these sections.

The potential profile provided by the first transition electrodes, spatial focussing electrode section and second transition electrodes may be a substantially quadratic potential.

The spectrometer may comprise an upstream electrode or device arranged upstream of the lens; wherein said one or more DC voltage supply is configured to apply the same DC potential to the ion entrance electrode section of the lens and the upstream electrode or device, optionally such that a substantially electric field-free region is provided between the upstream electrode or device and the ion entrance electrode section of the lens.

The spectrometer may comprise a downstream electrode or device arranged downstream of the lens; wherein said one or more DC voltage supply is configured to apply the same DC potential to the ion exit electrode section of the lens and the downstream electrode or device, optionally such that a substantially electric field-free region is provided between the downstream electrode or device and the ion exit electrode section of the lens.

The time of flight region for separating ions according to mass to charge ratio may consist of, or may comprise, the region between the upstream electrode or device and the downstream electrode or device.

The spectrometer may comprise a first ion mirror, wherein the upstream electrode is part of the first ion mirror, or the upstream device is the first ion mirror.

The spectrometer may comprise a second ion mirror, wherein the downstream electrode is part of the second ion mirror, or the downstream device is the second ion mirror.

The first and/or second ion mirror may be an ion mirror as described above in relation to the first aspect of the present invention. Alternatively, the upstream device may be a source of ions and/or the downstream device may be an ion detector.

The spectrometer may comprise a plurality of ion lenses, each lens configured as described above in relation to the third aspect of the present invention.

The spectrometer may comprise a number of lenses selected from the group consisting of: ≥2; ≥3; ≥4; ≥5; ≥6; ≥7; ≥8; ≥9; and ≥10.

The spectrometer may comprise at least one first ion mirror, and a first of the ion lenses may be arranged and configured such that, in use, ions exit the ion exit electrode section of the first lens, pass into the at least one first ion mirror, are reflected by the at least one first ion mirror, and enter into the ion entrance electrode section of a second of the ion lenses.

The spectrometer may comprise a second ion mirror, wherein the second lens is arranged and configured such that, in use, ions exit the ion exit electrode section of the second lens, pass into the second ion mirror, and are reflected by the second ion mirror; and, optionally, enter into an ion entrance electrode section of a third of the ion lenses.

The plurality of ion lenses may be arranged adjacent to one another with their longitudinal axes in parallel and extending in a direction between first and second ion mirrors.

One or more shielding electrode may be arranged laterally between adjacent ion lenses for providing an electric field free-region between the adjacent lenses and such that, in use, ions travel through the electric field free-region in between travelling through the laterally adjacent lenses. Optionally, an apertured or slotted member is provided in the electric field free-region for blocking the flight paths of ions that have diverged in the direction perpendicular to the longitudinal axis by more than a threshold amount, and for transmitting ions through the aperture or slot that have flight paths which have diverged in the direction perpendicular to the longitudinal axis by less than a threshold amount.

As an alternative to the use of transition electrodes, the present invention contemplates the use of electrodes that have a variable resistance along their length in order to graduate the potential profile more progressively towards the adjacent electrode sections.

Accordingly, according to a fourth aspect the present invention provides an ion mirror comprising:

an ion entrance electrode section at the ion entrance to the ion mirror;

an energy focussing electrode section for reflecting ions back along a longitudinal axis towards said ion entrance;

a spatial focussing electrode section arranged between the ion entrance electrode section and the energy focussing electrode section for spatially focussing the ions;

one or more DC voltage supply configured to apply DC voltages to the ion entrance electrode section, the spatial focussing electrode section and the energy focussing electrode section; and (i) wherein the spatial focussing electrode section comprises one or more resistive electrode having a variable resistance along its length such that when a DC voltage is applied to it the one or more resistive electrode generates a DC potential profile that progressively increases and/or decreases along at least part of the length of the spatial focussing electrode section; and/or (ii) wherein the ion entrance electrode section comprises one or more resistive electrode having a variable resistance along its length such that when a DC voltage is applied to it the one or more resistive electrode generates a DC potential profile that progressively decreases, or increases, along at least part of the length of the ion entrance electrode section in a direction from the ion entrance to the energy focussing section; and/or (iii) wherein the energy focussing electrode section comprises one or more resistive electrode having a variable resistance along its length such that when a DC voltage is applied to it the one or more resistive electrode generates a DC potential profile that progressively decreases along at least part of the length of the energy focussing electrode section in a direction from the energy focussing section to the ion entrance.

The restive electrodes of the present invention enable the axial electric potential profile along the longitudinal axis (X-dimension) of the different electrode sections to vary more smoothly and progressively. This enables a reduction in the spatial distortions of the ion beams in a dimension orthogonal to the longitudinal axis (e.g. reduces spatial distortions in the Y-dimension), as compared to conventional ion mirrors. The ion mirror of the present invention may therefore provide lower spatial and time-of-flight aberrations, enabling the spectrometer incorporating the mirror to have an increased mass resolving power as well being capable of being operated in imaging and parallel detection modes.

A spatial focussing potential that initially accelerates the ions may be preferred. Accordingly, the one or more DC voltage supply may be configured to apply a DC potential to the ion entrance electrode section that is intermediate a DC potential applied to the spatial focussing electrode section and a DC potential applied to the energy focussing electrode section.

The DC potential profile according to step (i) may progressively increase along the part of the length of the spatial focussing electrode section in a direction from the ion entrance to the energy focussing section, wherein this increasing DC potential profile is arranged in part of the spatial focussing electrode section substantially adjacent to the energy focussing section. Additionally, or alternatively, the DC potential profile according to step (i) may progressively decrease along the part of the length of the spatial focussing electrode section in a direction from the ion entrance to the energy focussing section, wherein this decreasing DC potential profile is arranged in part of the spatial focussing electrode section substantially adjacent to the ion entrance electrode section.

The DC potential profile according to step (ii) may progressively decrease along the part of the length of the ion entrance electrode section in a direction from the ion entrance electrode section to the energy focussing section, wherein this decreasing DC potential profile is arranged in part of the ion entrance electrode section substantially adjacent to the spatial focussing electrode section.

The DC potential profile according to step (iii) may progressively decrease along the part of the length of the energy focussing electrode section in a direction from the energy focussing electrode section to the ion entrance electrode section, wherein this decreasing DC potential profile is arranged in part of the energy focussing electrode section substantially adjacent to the spatial focussing electrode section.

Alternatively, a spatial focussing DC potential that initially decelerates the ions may be used. Accordingly, the DC potential profile according to step (i) may progressively increase along the part of the length of the spatial focussing electrode section in a direction from the ion entrance to the energy focussing section, wherein this increasing DC potential profile is arranged in part of the spatial focussing electrode section substantially adjacent to the ion entrance electrode section. Additionally, or alternatively, the DC potential profile according to step (i) may progressively decrease along the part of the length of the spatial focussing electrode section in a direction from the ion entrance to the energy focussing section, wherein this decreasing DC potential profile is arranged in part of the spatial focussing electrode section substantially adjacent to the energy focussing electrode section.

The DC potential profile according to step (ii) may progressively increase along the part of the length of the ion entrance electrode section in a direction from the ion entrance electrode section to the energy focussing section, wherein this increasing DC potential profile is arranged in part of the ion entrance electrode section substantially adjacent to the spatial focussing electrode section.

The DC potential profile according to step (iii) may progressively decrease along the part of the length of the energy focussing electrode section in a direction from the energy focussing electrode section to the ion entrance electrode section, wherein this decreasing DC potential profile is arranged in part of the energy focussing electrode section substantially adjacent to the spatial focussing electrode section.

The ion mirror according to the fourth aspect of the present invention may be configured for a time of flight mass analyser.

Ions enter the ion mirror along the longitudinal axis of the ion mirror (in the X-dimension) and are reflected back along that axis. The ion entrance electrode section, the spatial focussing electrode section and the energy focussing electrode section are longitudinal sections of the ion mirror spaced apart along the longitudinal axis.

The ion entrance electrode section may comprise one or more electrodes and said DC voltage supply may be configured to apply only a single potential, or the same potential, to the electrode(s) of the ion entrance electrode section; optionally such that the ion entrance electrode section is substantially a field-free region.

Alternatively, or additionally, an electrode of the ion entrance electrode section may extend continuously over the entire length of the ion entrance electrode section.

Optionally, at least 80%, at least 90% or at least 95% of the axial length of the ion entrance section is an electric field-free region.

The DC voltage supply may be configured to apply multiple different DC potentials to different electrodes of the energy focussing electrode section for reflecting ions back along the longitudinal axis towards said ion entrance. If a spatial focussing DC potential profile that initially accelerates ions is used, then the DC voltage supply may be configured to apply a DC potential to the ion entrance electrode section that is intermediate the DC potential applied to the spatial focussing electrode section and the lowest DC potential applied to the energy focussing electrode section.

Alternatively or additionally, although less desirably, the DC voltage supply may be configured to apply multiple different DC voltages to different electrodes of the spatial focussing electrode section. In this configuration, if a spatial focussing DC potential profile that initially accelerates ions is used, the DC voltage supply may be configured to apply a DC potential to the ion entrance electrode section that is intermediate the highest DC potential applied to the spatial focussing electrode section and the lowest DC potential applied to the energy focussing electrode section.

The ions mirror may have a length X along the longitudinal axis in a first dimension, a width Y in a second dimension orthogonal to said first dimension, and a drift length Z in a dimension orthogonal to both the first and second dimensions. The drift length Z may be greater than length X and/or width Y. Additionally, or alternatively, length X may be greater than width Y.

The ion entrance electrode section may have a length along the longitudinal axis (X-dimension) selected from the group consisting of: ≥30 mm; ≥40 mm; ≥50 mm; ≥60 mm; ≥70 mm; ≥80 mm; ≥90 mm; ≥100 mm; ≥110 mm; ≥120 mm; ≥130 mm; ≥140 mm; and ≥150 mm.

The spatial focussing electrode section may focus ions in a dimension (Y-dimension) that is orthogonal to said longitudinal axis (X-dimension).

The spatial focussing electrode section comprises one or more electrodes and said DC voltage supply may be configured to apply only a single potential, or the same potential, to the electrode(s) of the spatial focussing electrode section; and/or an electrode of the spatial focusing electrode section may extend continuously over the entire length of the spatial focussing electrode section.

The spatial focussing electrode section may have a length along the longitudinal axis (X-dimension) selected from the group consisting of: ≤100 mm; ≤90 mm; ≤80 mm; ≤70 mm; ≤60 mm; ≤50 mm; ≤40 mm; ≤30 mm; ≤20 mm; and/or ≥20 mm; ≥25 mm; ≥30 mm; ≥35 mm; ≥40 mm; ≥45 mm; ≥50 mm; ≥55 mm; and ≥60 mm.

The energy focussing electrode section may comprise at least two electrodes at different positions along the longitudinal axis, wherein the DC voltage supply is configured to apply a different potential to each of the at least two electrodes so as to provide an electric potential profile along the energy focussing electrode section for reflecting ions along the longitudinal axis towards said ion entrance.

Alternatively, or additionally, the energy focussing electrode section may comprise one or more electrodes having a resistive coating that varies in a direction along the longitudinal axis, and/or that is arranged at an angle to the longitudinal axis, such that when the voltage supply applies a voltage to the one or more electrodes an electric potential profile is arranged along the energy focussing electrode section that reflects ions along the longitudinal axis towards said entrance.

The energy focussing electrode section may have a length along the longitudinal axis (X-dimension) selected from the group consisting of: ≤100 mm; ≤90 mm; ≤80 mm; ≤70 mm; ≤60 mm; ≤50 mm; ≤40 mm; ≤30 mm; ≤20 mm; and/or ≥20 mm; ≥30 mm; ≥40 mm; ≥50 mm; ≥60 mm; ≥70 mm; ≥80 mm; ≥90 mm; ≥ and 100 mm.

The ion entrance section may have an internal width in a dimension (Y-dimension) orthogonal to the longitudinal axis selected from the group consisting of: ≥20 mm; ≥25 mm; ≥30 mm; ≥35 mm; ≥40 mm; ≥45 mm; ≥50 mm; ≥55 mm; and ≥60 mm.

The spatial focussing electrode section may have an internal width in a dimension (Y-dimension) orthogonal to the longitudinal axis selected from the group consisting of: ≥20 mm; ≥25 mm; ≥30 mm; ≥35 mm; ≥40 mm; ≥45 mm; ≥50 mm; ≥55 mm; and ≥60 mm.

The energy focussing electrode section may have an internal width in a dimension (Y-dimension) orthogonal to the longitudinal axis selected from the group consisting of: ≥20 mm; ≥25 mm; ≥30 mm; ≥40 mm; ≥50 mm; and ≥60 mm.

Any one of the one or more resistive electrodes described herein may have a length of variable resistance along the longitudinal axis (X-dimension) selected from the group consisting of: ≥1 mm; ≥2 mm; ≥3 mm; ≥4 mm; ≥5 mm; ≥10 mm; ≥15 mm; ≥20 mm; ≥25 mm; ≥30 mm; ≥35 mm; ≥40 mm; and ≥50 mm.

The spatial focussing section and ion entrance electrode section provide a smooth potential profile spanning these sections.

The spatial focussing electrode section and energy focussing electrode section provide a smooth potential profile spanning these sections.

The potential profile provided by the spatial focussing electrode section and the adjacent portions of the ion entrance electrode section and energy focussing electrode section may be a substantially quadratic potential, if a spatial focussing DC potential profile that initially accelerates ions is used.

The fourth aspect also provides a mass spectrometer comprising an ion mirror as described; or comprising two ion mirrors, each of the type described. The spectrometer may be configured such that, in use, ions are reflected between the two ion mirrors.

From a fifth aspect the present invention provides a time of flight mass spectrometer comprising:

a time of flight region for separating ions according to their mass to charge ratio; and an ion optical lens for spatially focussing ions arranged within the time of flight region, said lens comprising:

an ion entrance electrode section and an ion exit electrode section at opposite ends of the lens, and a spatial focussing electrode section arranged between the ion entrance and ion exit electrode sections for spatially focussing ions passing through the lens;

one or more DC voltage supply configured to apply DC voltages to the ion entrance electrode section, the spatial focussing electrode section and the ion exit electrode section; and to apply a DC potential to the spatial focussing electrode section that is either lower or greater than both a DC potential applied to the ion entrance electrode section and a DC potential applied to the ion exit electrode section; and (i) wherein the spatial focussing electrode section comprises one or more resistive electrode having a variable resistance along its length such that when a DC voltage is applied to it the one or more resistive electrode generates a DC potential profile that progressively increases and/or decreases along at least part of the length of the spatial focussing electrode section; and/or (ii) wherein the ion entrance electrode section comprises one or more resistive electrode having a variable resistance along its length such that when a DC voltage is applied to it the one or more resistive electrode generates a DC potential profile that progressively decreases, or increases, along at least part of the length of the ion entrance electrode section in a direction from the ion entrance electrode section to the ion exit electrode section; and/or (iii) wherein the ion exit electrode section comprises one or more resistive electrode having a variable resistance along its length such that when a DC voltage is applied to it the one or more resistive electrode generates a DC potential profile that progressively decreases, or increases, along at least part of the length of the ion exit electrode section in a direction from the ion exit electrode section to the ion entrance electrode section.

The restive electrodes of the present invention enable the axial electric potential profile along the longitudinal axis (X-dimension) of the different electrode sections to vary more smoothly and progressively. This enables a reduction in the spatial distortions of the ion beams in a dimension orthogonal to the longitudinal axis (e.g. reduces spatial distortions in the Y-dimension), as compared to conventional ion lenses. The ion lens of the present invention may therefore provide lower spatial and time-of-flight aberrations, enabling the spectrometer incorporating the lens to have an increased mass resolving power as well being capable of being operated in imaging and parallel detection modes.

A spatial focussing potential that initially accelerates the ions may be preferred. Accordingly, the one or more DC voltage supply may be configured to apply a DC potential to the spatial focussing electrode section that is lower than both a DC potential applied to the ion entrance electrode section and a DC potential applied to the ion exit electrode section.

The DC potential profile according to step (i) may progressively decrease along a part of the length of the spatial focussing electrode section in a direction from the ion entrance electrode section to the ion exit electrode section, wherein this decreasing DC potential profile is arranged in part of the spatial focussing electrode section substantially adjacent to the ion entrance electrode section. Additionally, or alternatively, the DC potential profile according to step (i) may progressively increase along part of the length of the spatial focussing electrode section in a direction from the ion entrance electrode section to the ion exit electrode section, wherein this increasing DC potential profile is arranged in part of the spatial focussing electrode section substantially adjacent to the ion exit electrode section.

The DC potential profile according to step (ii) may progressively decrease along said at least part of the length of the ion entrance electrode section in a direction from the ion entrance electrode section to the ion exit electrode section, wherein this decreasing DC potential profile is arranged in part of the ion entrance electrode section substantially adjacent to the spatial focussing electrode section.

The DC potential profile according to step (iii) may progressively decrease along said at least part of the length of the ion exit electrode section in a direction from the ion exit electrode section to the ion entrance electrode section, wherein this decreasing DC potential profile is arranged in part of the energy focussing electrode section substantially adjacent to the spatial focussing electrode section.

The electric potential profile may progressively decrease, without increasing, in the direction along the longitudinal axis from the ion entrance electrode section to the spatial focussing section.

The electric potential profile may progressively decrease, without increasing, in the direction along the longitudinal axis from the ion exit electrode section to the spatial focussing section.

Alternatively, a spatial focussing DC potential that initially decelerates the ions may be used. Accordingly, the DC potential profile according to step (i) may progressively increase along a part of the length of the spatial focussing electrode section in a direction from the ion entrance electrode section to the ion exit electrode section, wherein this increasing DC potential profile is arranged in part of the spatial focussing electrode section substantially adjacent to the ion entrance electrode section. Additionally, or alternatively, the DC potential profile according to step (i) may progressively decrease along part of the length of the spatial focussing electrode section in a direction from the ion entrance electrode section to the ion exit electrode section, wherein this decreasing DC potential profile is arranged in part of the spatial focussing electrode section substantially adjacent to the ion exit electrode section.

The DC potential profile according to step (ii) may progressively increase along said at least part of the length of the ion entrance electrode section in a direction from the ion entrance electrode section to the ion exit electrode section, wherein this increasing DC potential profile is arranged in part of the ion entrance electrode section substantially adjacent to the spatial focussing electrode section.

The DC potential profile according to step (iii) may progressively increase along said at least part of the length of the ion exit electrode section in a direction from the ion exit electrode section to the ion entrance electrode section, wherein this increasing DC potential profile is arranged in part of the energy focussing electrode section substantially adjacent to the spatial focussing electrode section.

The electric potential profile may progressively increase, without decreasing, in the direction along the longitudinal axis from the ion entrance electrode section to the spatial focussing section.

The electric potential profile may progressively increase, without decreasing, in the direction along the longitudinal axis from the ion exit electrode section to the spatial focussing section.

The lens according to the fifth aspect of the present invention may have a longitudinal axis. The ion entrance electrode section, spatial focussing electrode section and ion exit electrode section may be arranged sequentially along said longitudinal axis.

The lens may be formed from multiple pairs of opposing electrodes. Optionally, each electrode is a planar electrode. One or both of the electrodes in a pair may be the resistive electrodes.

The spatial focusing electrode section may focus the ions in a dimension (Z-dimension) perpendicular to the longitudinal axis (X-dimension).

The spectrometer may be configured such that ions enter, pass through and exit the lens with a component of velocity along the longitudinal axis (X-dimension) of the lens; and such that the ions enter, pass through and exit the lens with a component of velocity in the dimension (Z-dimension) perpendicular to the longitudinal axis (X-dimension).

The lens may be an einzel lens.

The spectrometer may be configured such that ions enter and exit the ion lens with substantially the same kinetic energy.

The ion entrance electrode section may comprise one or more electrodes and said DC voltage supply may be configured to apply only a single potential, or the same potential, to the electrode(s) of the ion entrance electrode section; optionally such that the ion entrance electrode section is substantially a field-free region.

An electrode of the ion entrance electrode section may extend continuously over the entire length of the ion entrance electrode section.

Optionally, at least 80%, at least 90% or at least 95% of the axial length of the ion entrance section is an electric field-free region.

The ion exit electrode section may comprise one or more electrodes and said DC voltage supply may be configured to apply only a single potential, or the same potential, to the electrode(s) of the ion exit electrode section; optionally such that the ion exit electrode section is substantially a field-free region.

An electrode of the ion exit electrode section may extend continuously over the entire length of the ion exit electrode section.

Optionally, at least 80%, at least 90% or at least 95% of the axial length of the ion exit section is an electric field-free region.

The ion lens may have a length X along the longitudinal axis in a first dimension, a width Y in a second dimension orthogonal to said first dimension, and a drift length Z in a dimension orthogonal to both the first and second dimensions. The drift length Z may be greater than length X and/or width Y. Additionally, or alternatively, length X may be greater than width Y.

The ion entrance electrode section and/or ion exit electrode section of the lens has a length along the longitudinal axis (X-dimension) selected from the group consisting of: ≥30 mm; ≥40 mm; ≥50 mm; ≥60 mm; ≥70 mm; ≥80 mm; ≥90 mm; ≥100 mm; ≥110 mm; ≥120 mm; ≥130 mm; ≥140 mm; ≥150 mm; ≥160 mm; ≥170 mm; ≥180 mm; ≥190 mm; and ≥200 mm.

The spatial focussing electrode section focuses ions in a dimension (Y-dimension) that is orthogonal to said longitudinal axis (X-dimension).

The spatial focussing electrode section may comprise one or more electrodes and said DC voltage supply may be configured to apply only a single potential, or the same potential, to the electrode(s) of the spatial focussing electrode section; and/or an electrode of the spatial focusing electrode section may extend continuously over the entire length of the spatial focussing electrode section.

The spatial focussing electrode section may have a length along the longitudinal axis (X-dimension) selected from the group consisting of: ≥20 mm; ≥25 mm; ≥30 mm; ≥35 mm; ≥40 mm; ≥45 mm; ≥50 mm; ≥55 mm; ≥60 mm; ≥70 mm; ≥80 mm; ≥90 mm; and ≥100 mm; and/or ≤100 mm; ≤90 mm; ≤80 mm; ≤70 mm; ≤60 mm; ≤50 mm; ≤40 mm; and ≤30 mm.

The ion lens may have a length along the longitudinal axis (X-dimension) selected from the group consisting of: ≥75 mm; ≥80 mm; ≥85 mm; ≥90 mm; ≥95 mm; ≥100 mm; ≥110 mm; ≥120 mm; ≥130 mm; ≥140 mm; ≥150 mm; ≥160 mm; ≥170 mm; ≥180 mm; ≥190 mm; ≥200 mm; ≥220 mm; ≥240 mm; ≥260 mm; ≥280 mm; ≥300 mm; ≥320 mm; ≥340 mm; ≥360 mm; ≥380 mm; and ≥400 mm; and/or ≤400 mm; ≤380 mm; ≤360 mm; ≤340 mm; ≤320 mm; ≤300 mm; ≤280 mm; ≤260 mm; ≤240 mm; ≤220 mm; ≤200 mm; ≤190 mm; ≤180 mm; ≤170 mm; ≤160 mm; ≤150 mm; ≤140 mm; ≤130 mm; ≤120 mm; ≤110 mm; and ≤100 mm.

The ion entrance section may have an internal width in a dimension (Y-dimension) orthogonal to the longitudinal axis selected from the group consisting of: ≥20 mm; ≥25 mm; ≥30 mm; ≥35 mm; ≥40 mm; ≥45 mm; ≥50 mm; ≥55 mm; and ≥60 mm.

The spatial focussing electrode section may have an internal width in a dimension (Y-dimension) orthogonal to the longitudinal axis selected from the group consisting of: ≥20 mm; ≥25 mm; ≥30 mm; ≥35 mm; ≥40 mm; ≥45 mm; ≥50 mm; ≥55 mm; and ≥60 mm.

The ion exit section may have an internal width in a dimension (Y-dimension) orthogonal to the longitudinal axis selected from the group consisting of: ≥20 mm; ≥25 mm; ≥30 mm; ≥35 mm; ≥40 mm; ≥45 mm; ≥50 mm; ≥55 mm; and ≥60 mm.

The ion entrance electrode section, spatial focussing electrode section and ion exit electrode section provide a smooth potential profile spanning these sections.

The potential profile provided by ion entrance electrode section, spatial focussing electrode section and ion exit electrode section may be a substantially quadratic potential.

The spectrometer may comprise an upstream electrode or device arranged upstream of the lens; wherein said one or more DC voltage supply is configured to apply a same DC potential to an ion entrance end of the ion entrance electrode section of the lens and said upstream electrode or device, optionally such that a substantially electric field-free region is provided between the upstream electrode or device and the ion entrance electrode section of the lens.

The spectrometer may comprise a downstream electrode or device arranged downstream of the lens; wherein said one or more DC voltage supply is configured to apply a same DC potential to a downstream end of the ion exit electrode section of the lens and said downstream electrode or device, optionally such that a substantially electric field-free region is provided between the downstream electrode or device and the ion exit electrode section of the lens.

The time of flight region for separating ions according to mass to charge ratio may consist of, or may comprise, the region between the upstream electrode or device and the downstream electrode or device.

The spectrometer may comprise a first ion mirror, wherein the upstream electrode is part of the first ion mirror, or the upstream device is the first ion mirror.

The spectrometer may comprise a second ion mirror, wherein the downstream electrode is part of the second ion mirror, or the downstream device is the second ion mirror.

The first and/or second ion mirror may be an ion mirror as described above in relation to the first aspect of the present invention. Alternatively, the upstream device may be a source of ions and/or the downstream device may be an ion detector.

The spectrometer may comprise a plurality of ion lenses, each lens configured as described above in relation to the third aspect of the present invention.

The spectrometer may comprise a number of lenses selected from the group consisting of: ≥2; ≥3; ≥4; ≥5; ≥6; ≥7; ≥8; ≥9; and ≥10.

The spectrometer may comprise at least one first ion mirror, and a first of the ion lenses may be arranged and configured such that, in use, ions exit the ion exit electrode section of the first lens, pass into the at least one first ion mirror, are reflected by the at least one first ion mirror, and enter into the ion entrance electrode section of a second of the ion lenses.

The spectrometer may comprise a second ion mirror, wherein the second lens is arranged and configured such that, in use, ions exit the ion exit electrode section of the second lens, pass into the second ion mirror, and are reflected by the second ion mirror; and, optionally, enter into an ion entrance electrode section of a third of the ion lenses.

The plurality of ion lenses may be arranged adjacent to one another with their longitudinal axes in parallel and extending in a direction between first and second ion mirrors.

One or more shielding electrode may be arranged laterally between adjacent ion lenses for providing an electric field free-region between the adjacent lenses and such that, in use, ions travel through the electric field free-region in between travelling through the laterally adjacent lenses. Optionally, an apertured or slotted member is provided in the electric field free-region for blocking the flight paths of ions that have diverged in the direction perpendicular to the longitudinal axis by more than a threshold amount, and for transmitting ions through the aperture or slot that have flight paths which have diverged in the direction perpendicular to the longitudinal axis by less than a threshold amount.

The spectrometer described herein may comprise an ion source array for supplying or generating ions over an array of positions and a position sensitive ion detector. The ion mirror and/or ion lens described in relation to the various aspects of the present invention may be arranged and configured to guide ions from the ion source array to the position sensitive detector so as to map ions from the array of positions on the ion source array to an array of positions on the position sensitive detector.

The ions may be mapped from the array of positions on the ion source array to a respective, corresponding array of positions on the position sensitive detector.

The ion mirrors described herein may be gridless ion mirrors. For the avoidance of doubt, a gridless ion mirror is an ion mirror having an ion flight region that is free from grids or meshes, such as electrode grids or meshes used to maintain electric fields.

The position sensitive detector may comprise an array of separate detection regions, wherein ions received at different detection regions are determined or assigned as having originated from different positions in the array of positions at the ion source array; and/or wherein ions received at any given position in the array of positions at the detector are determined or assigned as having originated from the corresponding position in the array of positions at the ion source array.

The spectrometer may comprise an ion accelerator for pulsing ions from the ion source array, downstream towards the detector. The spectrometer may be configured to determine the flight times of the ions from the ion accelerator to the detector. The spectrometer may therefore be configured to determine the mass to charge ratios of the ions from the flight times.

The ion accelerator may be an orthogonal accelerator for accelerating the ions orthogonally. Additionally, or alternatively, the ion accelerator may be a gridless ion accelerator. For the avoidance of doubt, a gridless ion accelerator is an ion accelerator having an ion acceleration or flight region that is free from grids or meshes, such as electrode grids or meshes used to maintain electric fields.

Ions detected at different locations of said array of locations at the detector may be recorded or summed separately.

As described above, the spectrometer may comprise at least two ion mirrors. The spectrometer may be configured such that the ions are reflected by each of the mirrors and between the mirrors a plurality of times before reaching the detector.

The ion mirrors may be spaced apart from each other in a first dimension (X-dimension) and may each be elongated in a second dimension (Z-dimension) that is orthogonal to the first dimension. The spectrometer may be configured such that the ions drift in the second dimension (Z-dimension) towards the detector as they are reflected between the mirrors.

The ion mirrors may be planar ion mirrors. Alternatively, the ion mirrors may be curved.

The spectrometer may comprise an ion introduction mechanism for introducing packets of ions into the space between the mirrors such that they travel along a trajectory that is arranged at an angle to the first and second dimensions such that the ions repeatedly oscillate in the first dimension (X-dimension) between the mirrors as they drift through said space in the second dimension (Z-dimension).

It is contemplated that rather than reflecting ions between two ion mirrors, one of the ion mirrors may be replaced by an electric or magnetic sector. Accordingly, the spectrometer may comprise at least one ion mirror for reflecting ions and at least one electrostatic or magnetic sector for receiving ions and guiding the ions into the at least one ion mirror; wherein the at least one ion mirror and at least one sector are configured such that the ions are transmitted from the at least one sector into each mirror a plurality of times such that the ions are reflected by said each ion mirror a plurality of times.

The array of positions at the ion source array and the array of positions at the detector may be one-dimensional arrays, or two-dimensional arrays.

Each position in the array of positions on the ion source array may be spatially separated from all of the other positions in the array of positions at the ion source array, and/or each position in the array of positions on the detector may be spatially separated from all of the other positions in the array of positions at the detector.

The ion source array may therefore be configured to supply or generate ions at an array of spatially separated positions.

Alternatively, each position in the array of positions on the ion source array may not be spatially separated from adjacent positions in the array of positions at the ion source array, and/or each position in the array of positions on the detector may not be spatially separated from adjacent positions in the array of positions at the detector.

The ion source array may be configured to supply or generate multiple ion beams or packets of ions at said array of positions from the same analytical sample source, or from different analytical sample sources.

The spectrometer may be configured to simultaneously map ions from the array of different positions on the ion source array to the array of different positions on the position sensitive detector. As such, the instrument may provide a high throughput.

The spectrometer may be configured to map ions to the detector from the array of positions at the ion source array, wherein the array of positions may extend ≥x mm in a first direction, wherein x is selected from the group consisting of: 1; 2; 3; 4; 5; 6; 7; 8; 9; and 10.

Optionally, the spectrometer may be configured to map ions to the detector from an array of positions at the ion source array wherein the array of positions may extend ≥y mm in a second direction orthogonal to the first direction, wherein y may be selected from the group consisting of: 1; 2; 3; 4; 5; 6; 7; 8; 9; and 10.

The array of positions at the ion source array may be in the form of a matrix having ≥n elements or positions in a first direction and ≥m elements or positions in a second orthogonal direction, wherein n may be selected from the group consisting of: 1; 2; 3; 4; 5; 6; 7; 8; 9; 10; 15; 20; 25; 30; 35; 40; 45; 50; 55; 60; 65; 70; 75; 80; 85; 90; 95; 100; 120; 140; 160; 180; and 200, and/or wherein m may be selected from the group consisting of: 1; 2; 3; 4; 5; 6; 7; 8; 9; 10; 15; 20; 25; 30; 35; 40; 45; 50; 55; 60; 65; 70; 75; 80; 85; 90; 95; 100; 120; 140; 160; 180; and 200.

The matrix may have a size in a first dimension selected from the group consisting of: ≥0.1 mm; ≥0.2 mm; ≥0.3 mm; ≥0.4 mm; ≥0.5 mm; ≥0.6 mm; ≥0.7 mm; ≥0.8 mm; ≥0.9 mm; ≥1 mm; ≥2.5 mm; ≥5 mm; ≥10 mm; ≥15 mm; ≥20 mm; ≥25 mm; ≥30 mm; ≥35 mm; ≥40 mm; and ≥50 mm; and optionally the matrix may have a size in a second dimension orthogonal to the first dimension that is selected from the group consisting of: ≥0.1 mm; ≥0.2 mm; ≥0.3 mm; ≥0.4 mm; ≥0.5 mm; ≥0.6 mm; ≥0.7 mm; ≥0.8 mm; ≥0.9 mm; ≥1 mm; ≥2.5 mm; ≥5 mm; ≥10 mm; ≥15 mm; ≥20 mm; ≥25 mm; ≥30 mm; ≥35 mm; ≥40 mm; and ≥50 mm.

An array of ion beams or ion packets may be formed at the ion source array, and each ion beam or ion packet may have a diameter of at least 0.25 mm, at least 0.5 mm, at least 0.75 mm, at least 1 mm, at least 1.25 mm, or at least 1.5 mm.

An array of ion beams or ion packets is received at the detector, wherein each ion beam or ion packet may have a diameter of at least 0.25 mm, at least 0.5 mm, at least 0.75 mm, at least 1 mm, at least 1.25 mm, or at least 1.5 mm.

The diameter of each ion beam or ion packet may be larger at the detector than at the ion source array.

An array of ion beams or ion packets may be formed at the ion source array, wherein the spatial pitch between the ion beams or ion packets may be selected from the list comprising: ≥0.1 mm; ≥0.2 mm; ≥0.3 mm; ≥0.4 mm; ≥0.5 mm; ≥0.6 mm; ≥0.7 mm; ≥0.8 mm; ≥0.9 mm; ≥1 mm; ≥2.5 mm; ≥5 mm; and ≥10 mm.

The spectrometer may comprise an electrostatic and/or magnetic sector for guiding ions from the ion source array downstream towards the ion mirror and/or lens; and/or may comprise an electrostatic and/or magnetic sector for guiding ions from the ion mirror and/or lens downstream towards the detector.

Using sector interfaces allows a relatively large ion source array and detector to be arranged outside of the TOF region, whilst introducing ions into and extracting ions from the TOF region. Also, sectors are capable of removing excessive energy spread of the ions so as to optimize spatial and mass resolution with only moderate ion losses. Sectors may also be used as part of telescopic arrangements for optimal adoption of spatial scales between the ion source, the TOF analyzer and the detector. The relatively low ion optical quality of sectors is not problematic, since ions spend only a relatively small portion of flight time in these sectors.

The spectrometer may comprise an orthogonal accelerator for orthogonally accelerating ions into one of the ion mirrors, optionally wherein the orthogonal accelerator is a gridless orthogonal accelerator.

The spectrometer may comprise an apertured or slotted member for blocking the flight paths of ions that have diverged in the direction perpendicular to the longitudinal axis by more than a threshold amount, and for transmitting ions through the aperture or slot that have flight paths which have diverged in the direction perpendicular to the longitudinal axis by less than a threshold amount.

The present invention provides a method of mass spectrometry using the ion mirror or spectrometer described herein.

According to the first aspect, the present invention provides a method of reflecting ions or a method of mass spectrometry comprising:

supplying ions to the ion entrance electrode section of an ion mirror as described in relation to the first aspect of the present invention;

applying a DC potential to the ion entrance electrode section that is intermediate the DC potential applied to the spatial focussing electrode section and the DC potential applied to the energy focussing electrode section; and (i) applying a DC potential to said at least one first transition electrode that is intermediate the DC potential applied to the ion entrance electrode section and the DC potential applied to the spatial focussing electrode section; and/or (ii) applying a DC potential to said at least one second transition electrode that is intermediate the DC potential applied to the spatial focussing electrode section and the DC potential applied to the ion entrance electrode section.

According to the second aspect, the present invention provides a method of reflecting ions or mass spectrometry comprising:

supplying ions to the ion entrance electrode section of an ion mirror as described in relation to the second aspect of the present invention;

applying a DC potential to the ion entrance electrode section that is intermediate the DC potential applied to the spatial focussing electrode section and the DC potential applied to the energy focussing electrode section; and (i) applying a DC potential to said at least one first transition electrode that is intermediate the DC potential applied to the ion entrance electrode section and the DC potential applied to the spatial focussing electrode section; and/or (ii) applying a DC potential to said at least one second transition electrode that is below the DC potential applied to the spatial focussing electrode section.

According to the third aspect, the present invention provides a method of time of flight mass spectrometry comprising:

providing a spectrometer as described in relation to the third aspect of the present invention;

separating ions according to their mass to charge ratio in the time of flight region;

spatially focussing ions within the time of flight region using the ion optical lens by:

applying a DC potential to the spatial focussing electrode section that is either lower or greater than both the DC potential applied to the ion entrance electrode section and the DC potential applied to the ion exit electrode section; and (i) applying a DC potential to said at least one first transition electrode that is intermediate the DC potential applied to the ion entrance electrode section and the DC potential applied to the spatial focussing electrode section; and/or (ii) applying a DC potential to said at least one second transition electrode that is intermediate the DC potential applied to the ion exit electrode section and the DC potential applied to the spatial focussing electrode section.

According to the fourth aspect, the present invention also provides a method of reflecting ions or mass spectrometry comprising:

supplying ions to the ion entrance electrode section of an ion mirror as described in relation to the fourth aspect;

applying DC voltages to the ion entrance electrode section, the spatial focussing electrode section and the energy focussing electrode section; and (i) wherein the spatial focussing electrode section comprises one or more resistive electrode having a variable resistance along its length, and the method comprises applying a DC voltage to the one or more resistive electrode so as to generate a DC potential profile that progressively increases and/or decreases along at least part of the length of the spatial focussing electrode section; and/or (ii) wherein the ion entrance electrode section comprises one or more resistive electrode having a variable resistance along its length, and the method comprises applying a DC voltage to the one or more resistive electrode so as to generate a DC potential profile that progressively decreases, or increases, along at least part of the length of the ion entrance electrode section in a direction from the ion entrance to the energy focussing section; and/or (iii) wherein the energy focussing electrode section comprises one or more resistive electrode having a variable resistance along its length, and the method comprises applying a DC voltage to the one or more resistive electrode so as to generate a DC potential profile that progressively decreases along at least part of the length of the energy focussing electrode section in a direction from the energy focussing section to the ion entrance.

The ion mirror used in the method may have any of the features described in relation to the fourth aspect of the present invention.

According to the fifth aspect, the present invention provides a method of time of flight mass spectrometry comprising:

providing a spectrometer as described in relation to the fifth aspect;

separating ions according to their mass to charge ratio in the time of flight region;

spatially focussing ions within the time of flight region using the ion optical lens by:

applying a DC potential to the spatial focussing electrode section that is either lower or greater than both a DC potential applied to the ion entrance electrode section and a DC potential applied to the ion exit electrode section; and (i) wherein the spatial focussing electrode section comprises one or more resistive electrode having a variable resistance along its length, and wherein the method comprises applying a DC voltage to this one or more resistive electrode so as to generate a DC potential profile that progressively increases and/or decreases along at least part of the length of the spatial focussing electrode section; and/or (ii) wherein the ion entrance electrode section comprises one or more resistive electrode having a variable resistance along its length, and wherein the method comprises applying a DC voltage to this one or more resistive electrode so as to generate a DC potential profile that progressively decreases, or increases, along at least part of the length of the ion entrance electrode section in a direction from the ion entrance electrode section to the ion exit electrode section; and/or (iii) wherein the ion exit electrode section comprises one or more resistive electrode having a variable resistance along its length, and wherein the method comprises applying a DC voltage to this one or more resistive electrode so as to generate a DC potential profile that progressively decreases, or increases, along at least part of the length of the ion exit electrode section in a direction from the ion exit electrode section to the ion entrance electrode section.

The spectrometer used in the method may have any of the features described in relation to the fifth aspect of the present invention.

The spectrometer disclosed herein may comprise an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source.

The spectrometer may comprise one or more continuous or pulsed ion sources.

The spectrometer may comprise one or more ion guides.

The spectrometer may comprise one or more ion mobility separation devices and/or one or more Field Asymmetric Ion Mobility Spectrometer devices.

The spectrometer may comprise one or more ion traps or one or more ion trapping regions.

The spectrometer may comprise one or more collision, fragmentation or reaction cells selected from the group consisting of: (i) a Collisional Induced Dissociation ("CID")

fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The spectrometer may comprise a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

The spectrometer may comprise one or more energy analysers or electrostatic energy analysers.

The spectrometer may comprise one or more ion detectors.

The spectrometer may comprise one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter.

The spectrometer may comprise a device or ion gate for pulsing ions; and/or a device for converting a substantially continuous ion beam into a pulsed ion beam.

The spectrometer may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The spectrometer may comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The spectrometer may comprise a chromatography or other separation device upstream of an ion source. The chromatography separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

Analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

Optionally, in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

Optionally, in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

The process of Electron Transfer Dissociation fragmentation may comprise interacting analyte ions with reagent ions, wherein the reagent ions comprise dicyanobenzene, 4-nitrotoluene or azulene.

A chromatography detector may be provided, wherein the chromatography detector comprises either:

a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

The stigmatic or imaging performance of a MR-TOF-MS instrument has previously been limited by the field distortions between the ion optical elements responsible for spatial focusing and their immediately adjacent electrodes. These distortions are reduced in the embodiments of the present invention by decreasing the field discontinuities between adjacent ion optical elements, thus allowing for a much larger field of view than previously achieved in known MR-TOF-MS and sector TOF instruments.

BRIEF DESCRIPTION OF THE DRAWINGS

Various embodiments will now be described, by way of example only, and with reference to the accompanying drawings in which.

DETAILED DESCRIPTION

The present invention provides an improved ion mirror and improved ion lens that may be used to improve ion mapping in a MR-TOF-MS.

Figure 1:
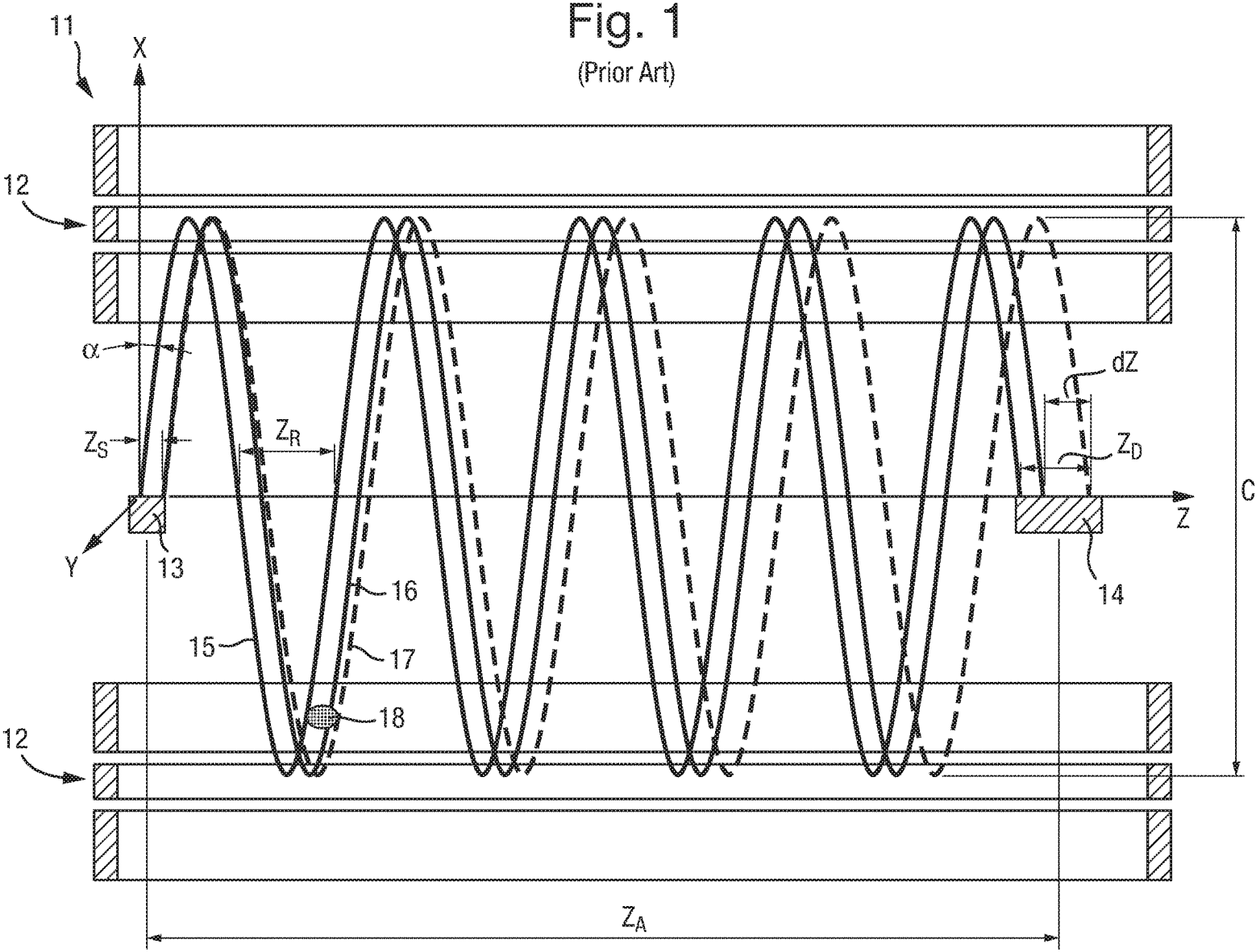
Fig. 1 (Prior Art)
FIG. 1 shows a schematic of a prior art MR-TOF-MS instrument.

In order to assist the understanding of the embodiments of the present invention, a prior art instrument will now be described with reference to FIG. 1. FIG. 1 shows a schematic of the 'folded path' planar MR-TOF-MS. The planar MR-TOF-MS 11 comprises two electrostatic mirrors 12, each composed of three electrodes that are extended in the drift Z-direction. Each ion mirror forms a two-dimensional electrostatic field in the X-Y plane. An ion source 13 (e.g. pulsed ion converter) and an ion detector 14 are located in the drift space between said ion mirrors 12 and are spaced apart in the Z-direction. Ion packets are produced by the source 13 and are injected into the time of flight region at a small inclination angle $\alpha$ to the X-axis. The ions therefore have a velocity in the X-direction and also have a drift velocity in the Z-direction. The ions are reflected between the ion mirrors 12 multiple times as they travel in the Z-direction from the source 13 to the receiver 14. The ions thus have substantially sinusoidal or jigsaw ion trajectories 15,16,17 through the device.

The ions advance in the drift Z-direction by an average distance of $Z_R \sim C^* \sin \alpha$ for each mirror reflection, where C is the distance in the X-direction between the ion reflection points. The ion trajectories 15 and 16 represent the spread of trajectories caused by the initial ion packet width $Z_S$ in the ion source 13. The trajectories 16 and 17 represent the angular divergence of the ion packet, which increases the ion packet width by dZ at the detector 14. The overall spread of the ion packet by the time that it reaches the detector 14 of represented by $Z_D$.

The MR-TOF-MS 11 provides no ion focusing in the drift Z-direction, thus limiting the number of reflection cycles that can be performed before the beam becomes overly dispersed by the time it reaches the detector 14. This arrangement therefore requires an ion trajectory advance per mirror reflection $Z_R$ that is above a certain value in order to avoid ion trajectories overlapping and causing spectral confusion. As such, the number of ion reflections for an instrument of practical length in the Z-direction is limited to a relatively low value.

It is known to introduce periodic lenses into the field-free region between the ion mirrors in order to limit the divergence of the ion beam in the Z-dimension, so as to overcome the above-described problem, e.g. as described in WO 2005/001878.

Figure 2A:
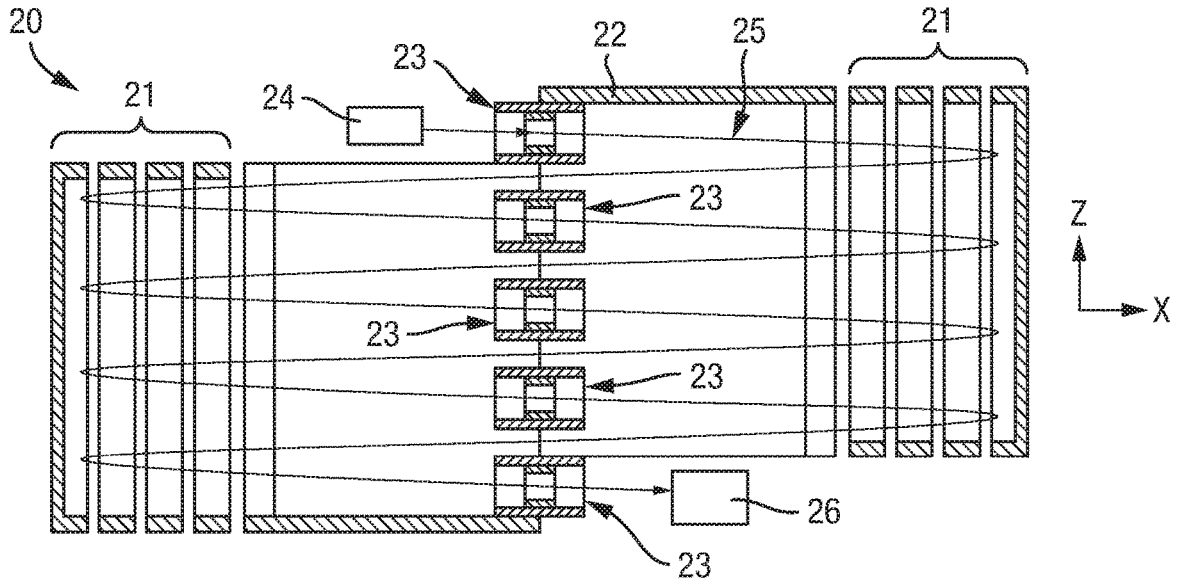
Fig. 2A (Prior Art)
FIGS. 2A-2B show schematic views of a prior art MR-TOF-MS instrument having periodic lenses.
Figure 2B:
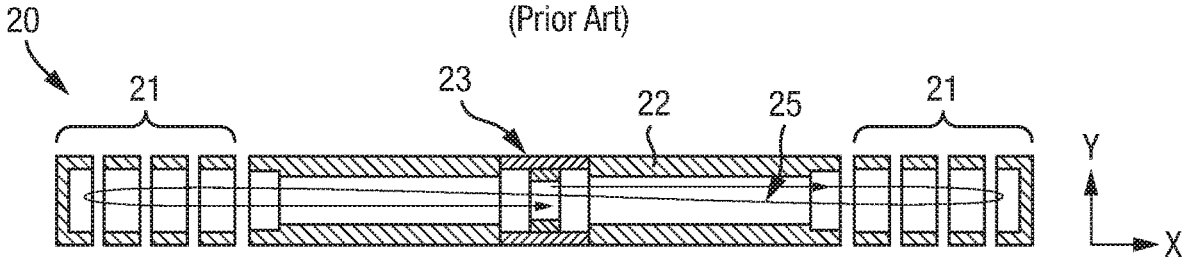
Fig. 2B (Prior Art)

FIGS. 2A and 2B illustrate a prior art instrument that is the same as that shown in FIG. 1, except that periodic lenses 23 are introduced into the field-free region between the ion mirrors. The instrument is therefore a multi-reflecting mass spectrometer 20 comprising a pair of planar mirrors 21, a drift space 22, a periodic lens array 23, a pulsed ion source 24 and a detector 26. FIG. 2A shows a view in the instrument in the X-Z plane and FIG. 2B shows a view in the instrument in the X-Y plane. The ions are pulsed into the drift space 22 between the ion mirrors 21 such that they perform multiple reflections between the ion mirrors 21 as they drift in the z-direction to the detector 26. The multiple mirror reflections extend the flight path of the ions, which improves mass resolution. The periodic lens 23 confine the ion packets along the main sinusoidal or zig-zag trajectory 25. The number of ion reflections shown in the drawings is for illustrative purposes and although the number of ion reflections illustrated in FIG. 2A is fewer than the number shown in FIG. 1 this is not intended to be significant. To the contrary, the provision of the periodic lenses shown in FIG. 2A enable a greater number of ion reflections per given distance in the Z-dimension as described in the Background section above.

The inventors of the present invention have recognised that the MR-TOF-MS instrument has useful stigmatic or ion mapping properties that may be useful for imaging an ion source, or multiple ion sources, onto a detector. The spatial focusing and image mapping properties instruments having (e.g. gridless) planar ion mirrors have not previously been appreciated and have not been used for multiple practical reasons.

Figure 3:
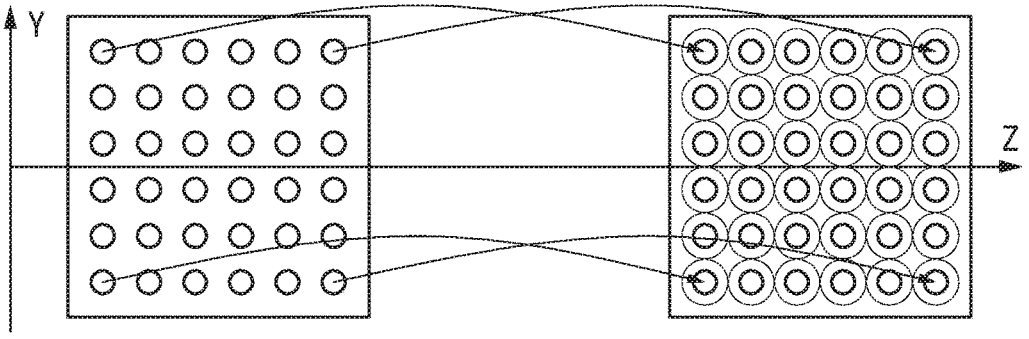
FIG. 3 illustrates the ion mapping properties of an MR-TOF-MS instrument.

FIG. 3 schematically illustrates the ability of the MR-TOF-MS analyzer to map ions from regions of a source of ions to corresponding regions on an array of regions downstream of the time of flight region. The coordinate system shown in FIG. 3 is the same coordinate system used in FIGS. 1-2. As described previously, ion reflections and time of flight separation primarily occur in the X-dimension, enabling the mass to charge ratios of the ions to be determined from the times of flight from the source of ions to the detector. However, the inventors have recognised that some degree of spatial information in the Y and Z dimensions is also retained as the ions pass from the source of ions to the downstream end of the time of flight region, i.e. the instrument maps ions. A position sensitive detector can therefore be provided downstream of the time of flight region such that ions are mapped from an array of regions on the source of ions to a corresponding array of regions on the position sensitive detector. Pixelated detectors, such as those disclosed in U.S. Pat. No. 8,884,220, may be used to record time-of-flight signals from a matrix of individual pixels in the detector by using an array channel data system.

The stigmatic, imaging or ion mapping performance of such an analyser can be used in two different regimes; a macroscopic mode or a microscopic mode. In the macroscopic mode, ions may be mapped from a relatively large area, e.g. 10×10 mm, onto a position sensitive detector. This enables the instrument, for example, to map multiple input ion beams to the detector. In the microscope mode, ions may be mapped from a smaller area, e.g. 1×1 mm, to the detector. In this mode the ions may be mapped at much higher spatial resolutions. The input ion beam(s) used for the two modes of operation may have different characteristics. For example, the macroscopic mode may use ion beams having a more diffuse set of characteristics representative of the input conditions to be expected from multiple ion beam sources. The ions beam(s) used in the microscope mode may have a brighter set of characteristics, e.g. such as would be expected from a SIMS or MALDI source.

As described above, the inventors have recognised that the MR-TOF-MS instrument has useful stigmatic or ion mapping properties that may be useful for imaging an ion source, or multiple ion sources, onto a detector. However, the inventors have also recognised that the stigmatic or ion mapping performance may be improved by reducing the aberrations associated with components of the instrument. Embodiments of these improvements will now be described using the known MR-TOF-MS analyser shown in FIG. 4 as an illustrative example.

Figure 4:
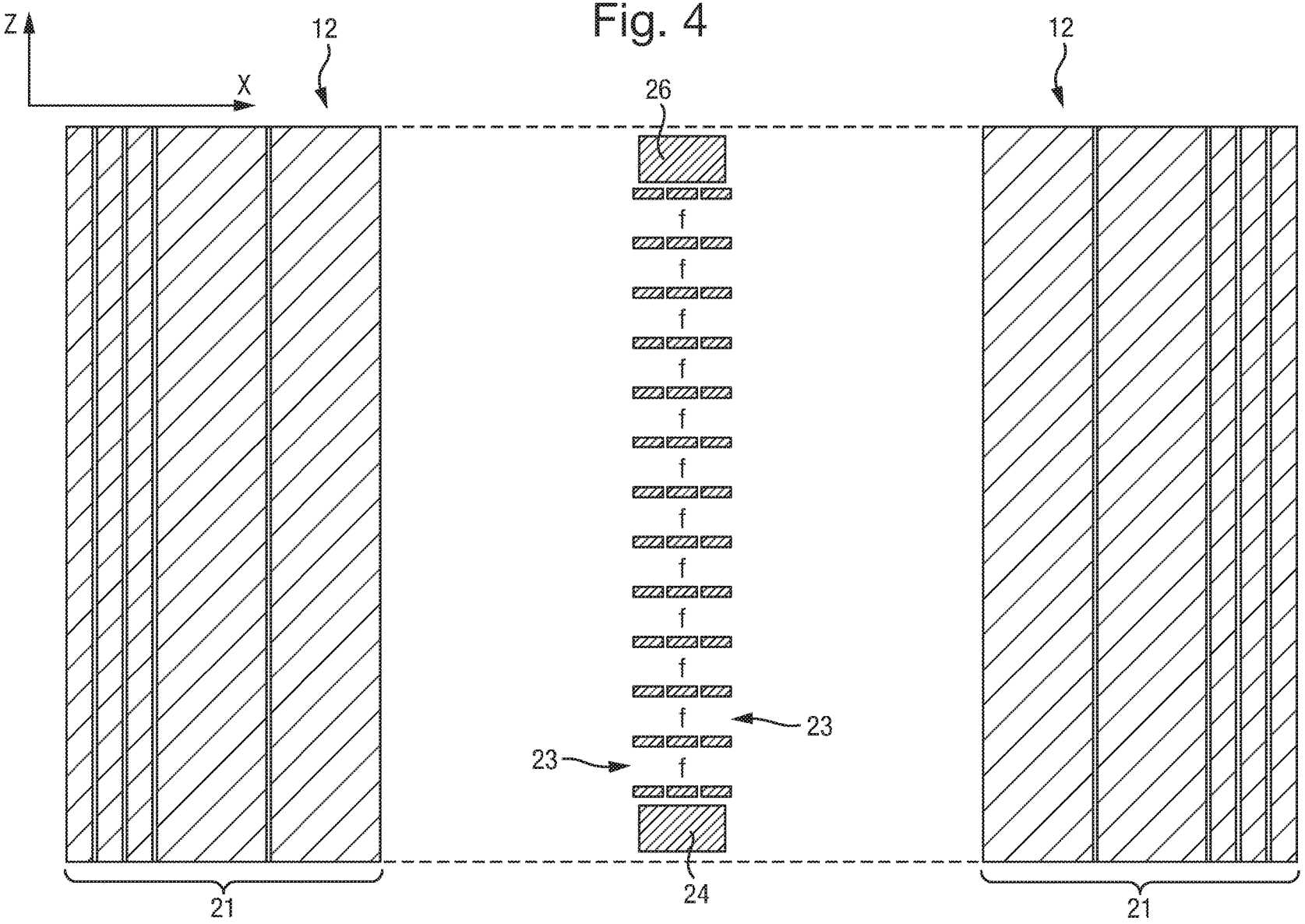
FIG. 4 shows a simplified schematic of a prior art MR-TOF-MS instrument having periodic lenses.

FIG. 4 shows a schematic of the known analyser shown in FIGS. 2A-2B, albeit with a greater number of periodic lenses 23. More specifically, FIG. 2A only shows five periodic lenses 23, whereas FIG. 4 shows twelve periodic lenses 23, each defining an ion Z-focussing region f. The electrode geometry is described above in relations to FIGS. 1 and 2, and also for example in WO 2013/063587. The analyser is optimised for high order time and energy focussing, meaning that it can achieve a relatively high isochronicity, i.e. a high time of flight resolution for incoming ion beams having a relatively large energy spread. In instrument configurations using an orthogonal accelerator 24 to inject ions into the time of flight region, the energy spread is caused by the spatial spread of the ions in the orthogonal acceleration region since ions at different spatial positions pick up different energies during the acceleration step. The ion mirror 21 is able to accept an ion beam having an energy spread of over 10% of the average energy of ions in the fight tube (which may be 6 keV for this analyser).

Despite the excellent energy acceptance of this analyser due to the elimination of higher order energy aberration coefficients, its stigmatic or ion mapping performance is limited. For example, for the given input ion beam conditions, the smallest spot size in the Y-dimension that could be expected to be mapped to the detector 26 (e.g. as shown in FIG. 3) is about 2 mm in diameter. If the mapping field is 8 mm, then the mapping capacity is limited to only four spots. The number of reflections in the ion mirrors 21 may be reduced (e.g. to eight) in order to reduce the spatial blurring at the image plane. However, this would strongly compromise the time-of-flight resolution of the instrument.

The ion mapping resolution in the Z-dimension is even lower than in the Y-dimension, due to the spatial aberration characteristics of the periodic lenses. For example, in a commercial Pegasus MR-TOF-MS instrument, the periodic lenses 23 are densely packed in order to enable a total of 32 or 44 reflections from the ion mirrors 21. The ion trajectories fill over 70% of the lens windows, and the lenses 23 are set to refocus ion packets every two or three ion mirror reflections. At such settings, the analyser fully smears the Z-spatial information of the ion packets due to high order aberrations of the lenses. The width of each lens 23 may be increased, the strength of each lens 23 may be reduced and the number of ion mirror reflections may be reduced (although this compromises the time-of-flight resolution) in order to improve the mapping capacity of the instrument. For example, an instrument having lenses 23 of twice the width, half the strength and a quarter of the ion mirror reflections may enable one to reach a spatial mapping capacity of 4 to 5.

Figure 5A:
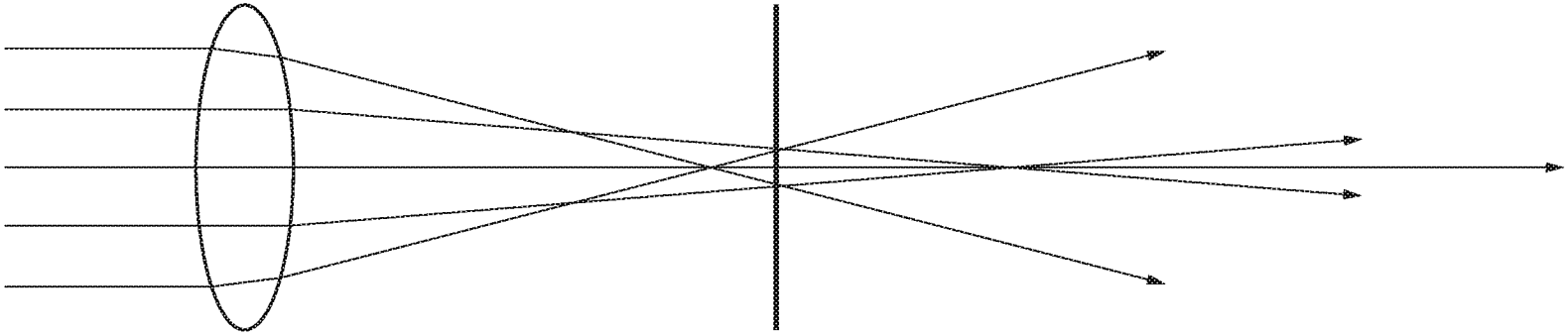
FIG. 5A shows the focal properties of an ion optical element having aberrations.
Figure 5B:
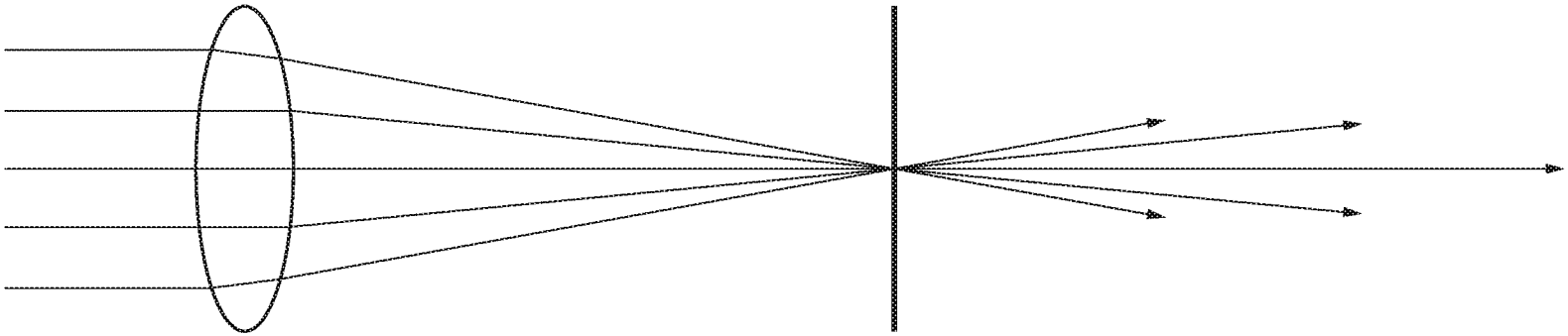
FIG. 5B shows the focal properties of an ion optical element having no aberrations.

FIGS. 5A and 5B illustrate the concept of spatial aberrations. FIG. 5A shows how the spatial aberrations of an imperfect ion lens do not focus the ions to the same point, leading to blurring of the image in the image plane (i.e. at the ion detector 26). In contrast, FIG. 5B shows the use of an ion lens having no spatial aberrations and that focuses the ions to the same point, resulting in a non-blurred image at the image plane (i.e. detector 23). Embodiments of the present invention serve to minimise the distortions created by spatial aberrations.

The present invention may be employed in MR-TOF-MS instruments of the type shown and described in relation to FIGS. 1-4. Embodiments of the present invention serve to minimise spatial aberrations caused by the ion mirrors 21 and/or the periodic lenses 23.

The spatial aberrations caused by ions mirrors will now be described.

Figure 6A:
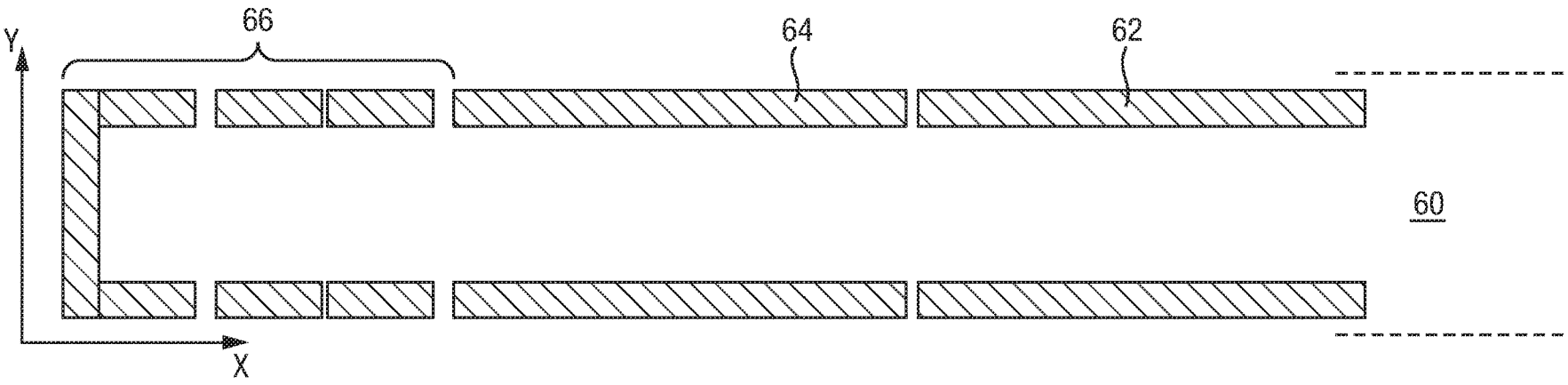
FIG. 6A shows a schematic of a prior art ion mirror.

FIG. 6A shows a schematic of a cross-section in the X-Y plane of a known ion mirror, e.g. such as an ion mirror of the type described in relation to FIGS. 1, 2 and 4. Ions enter the ion mirror from a time of flight region 60 at the right side of the mirror, pass through the ion mirror to the left (in the X-dimension), are reflected and then pass to the right (in the X-dimension) and out of the mirror. The rightmost side of the mirror comprises an ion entrance electrode section 62 that is maintained at a DC potential that defines the potential of the time of flight region (i.e. the flight tube potential). A Y-focussing electrode section 64 is provided adjacent to this for spatially focussing ions in the Y-dimension. This electrode section 64 is maintained at a lower DC voltage than the ion entrance electrode section (or at a higher DC voltage, depending on the polarity of the ions) so as to form an ion focussing section that initially accelerates ions. An energy focussing electrode section 66 is arranged adjacent to the Y-focussing electrode section 64. The energy focussing electrode section 66 comprises three electrode sections and an end cap electrode. These electrodes 66 are maintained at higher DC voltages than both the Y-focussing electrode section 64 and the ion entrance electrode section 62 (or at lower DC voltages, depending on the polarity of the ions) so as to decelerate the ions that have entered the ion mirror and reflect them back towards and out of the entrance to the ion mirror. The DC potential profile 61 along the X-dimension of the known ion mirror is shown in FIG. 6C as the solid line. The horizontal broken line represents the potential of the flight tube potential.

The Y-focussing electrode section 64 provides a two dimension accelerating field in the X-Y plane. Such a field is necessary to enable the efficient transmission of ions, especially over the very large flight paths of MR-TOF-MS analysers. However, as known MR-TOF-MS instruments have not previously been recognised as being useful for ion mapping and have conventionally been used with non-position sensitive ion detectors (e.g. with a single point ion detector), no attention was paid to the stigmatic or ion mapping properties of the ion mirror. The inventors of the present invention realised that instrument is useful for ion mapping and that the image produced by the ion mapping could be improved (e.g. reduced image blurring at the ion detector) by graduating the electric field between the ion mirror electrodes more progressively. More specifically, the inventors recognised that it is desirable, at least for ion mapping applications, to graduate the change in potential difference between the Y-focussing electrode section 64 and the adjacent ion entrance electrode section 62 more progressively; and to graduate the change in potential difference between the Y-focussing electrode section 64 and the adjacent energy focussing electrode section 66 more progressively. The ion beam cross-section in the Y-dimension is typically at its widest within section 64 of the ion mirror. Progressive graduation of the electric field in this section smoothes the field distribution so that the mirror has a "virtual" aperture that is much larger in the Y-dimension that the real aperture. This essentially reduces the ratio of the beam cross-section to the "virtual" mirror aperture and thus allows the aberrations of the ion mirror to be reduced.

Figure 6B:
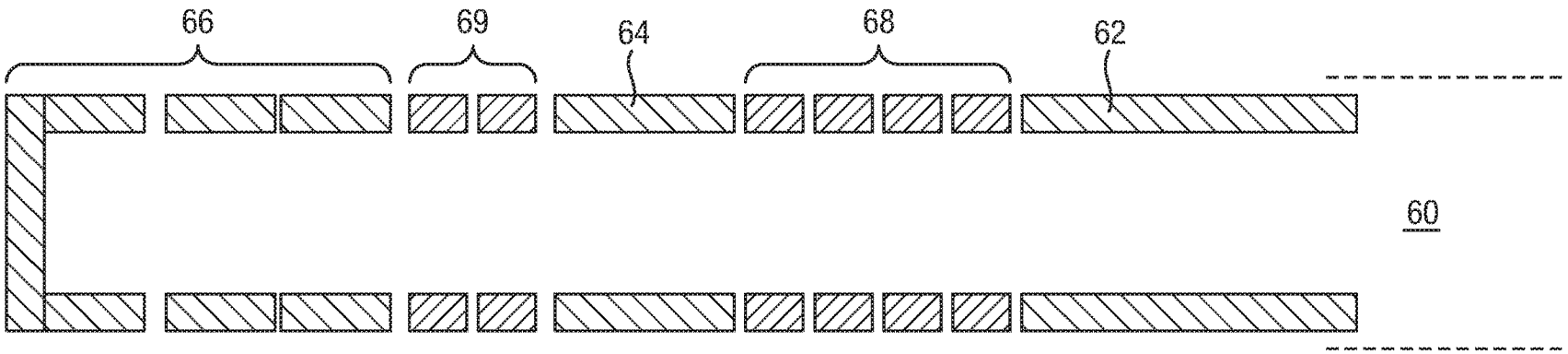
FIG. 6B shows a schematic of an ion mirror according to an embodiment of the present invention.
Figure 6C:
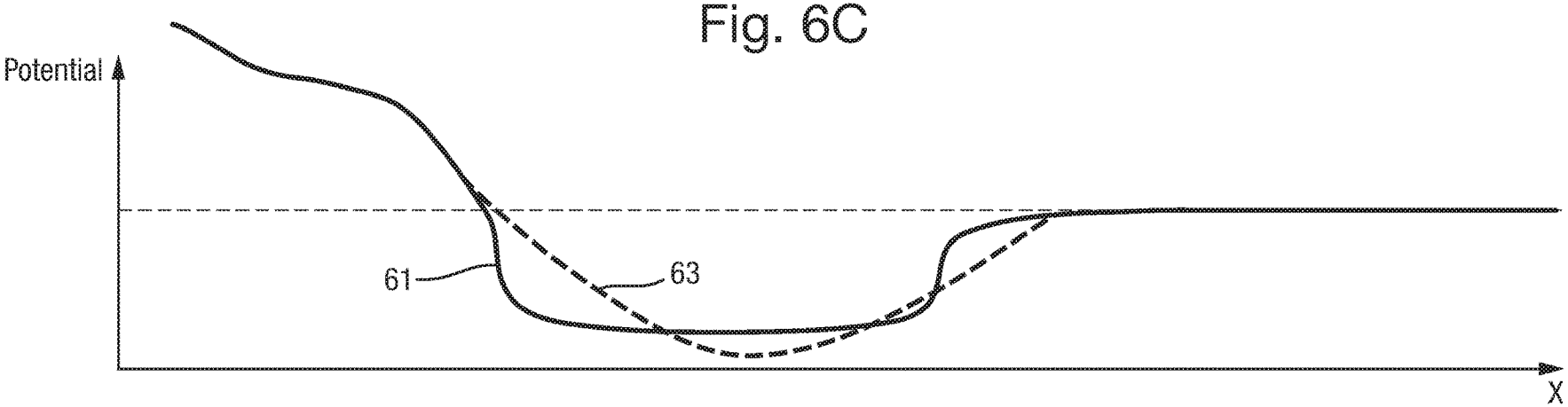
FIG. 6C shows the potential profiles along the longitudinal axes of the prior art ion mirror and the ion mirror according to the embodiment of the present invention.

FIG. 6B shows a schematic of an ion mirror according to an embodiment of the present invention. The ion mirror is substantially the same as that shown in FIG. 6A, except that first transition electrodes 68 are arranged between the ion entrance electrode section 62 and the Y-focussing electrode section 64, and second transition electrodes 69 are arranged between the Y-focussing electrode section 64 and the energy focussing electrode section 66. DC voltages are applied to the first transition electrodes 68 that have amplitudes between the amplitude of the DC voltage applied to the ion entrance electrode section 62 and the amplitude of the DC voltage applied to the Y-focussing electrode section 64. The different DC voltages applied to the respective different first transition electrodes progressively decrease in a direction from the ion entrance electrode section 62 to the Y-focussing electrode section 64 (or increase, depending on the polarity of the ions) so that the Y-focussing electrode section 64 initially accelerates the ions. DC voltages are applied to the second transition electrodes 69 that have amplitudes between the amplitude of the DC voltage applied to the Y-focussing electrode section 64 and the amplitude of the DC voltage applied to the closest of the energy focussing electrodes 66. The different DC voltages applied to the respective different second transition electrodes 69 progressively increase in a direction from the Y-focussing electrode section 64 to the energy focussing electrode section 66 (or decrease, depending on the polarity of the ions). The DC potential profile along the X-dimension 63 of the ion mirror is shown in FIG. 6C. The potential profile 63 substantially corresponds to the conventional potential profile 61, except that it differs in the region between the ion entrance electrode section 62 and the energy focussing electrode section 66, as shown by the curved dashed line.

As can be seen from FIG. 6C, the inclusion of the first and second transition electrodes 68,69 smoothes out the voltage transition between the electrodes of the ion mirror, as compared to the conventional mirror. This reduces the spatial aberrations caused by the ion mirror and improves the ion mapping properties of the instrument.

The ion mirror of this embodiment employs a potential profile for focussing ions in the Y-focussing section 64 that initially accelerates the ions. It is also possible to focus ions using a potential profile for focussing ions in the Y-focussing section 64 that initially decelerates the ions, although this is generally less preferred.

Figure 6D:
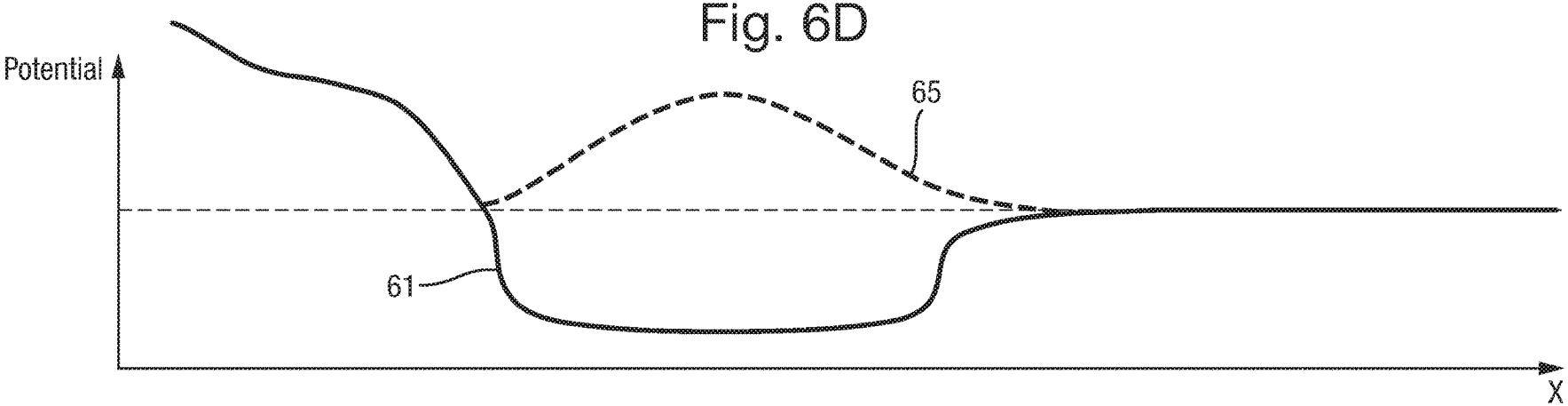
FIG. 6D shows the potential profiles along the longitudinal axes of the prior art ion mirror and an ion mirror according to another embodiment of the present invention.

FIG. 6D shows the conventional potential profile 61 shown in FIG. 6C and also a potential profile 65 along the X-dimension of an ion mirror according to an embodiment of the present invention in which a potential profile that initially decelerates the ions is used for focussing ions in the Y-focussing section 64. The ion mirror is the same as that shown in FIG. 6B, but different DC voltages are applied to the electrodes. In this embodiment, the DC voltage applied to the Y-focussing electrode section 64 is greater than the DC voltage applied to the ion entrance electrode section 62, but less than the greatest of the DC voltages applied to the energy focussing electrode section 66. DC voltages are applied to the first transition electrodes 68 that have amplitudes between the amplitude of the DC voltage applied to the ion entrance electrode section 62 and the amplitude of the DC voltage applied to the Y-focussing electrode section 64. The different DC voltages applied to the respective different first transition electrodes progressively increase in a direction from the ion entrance electrode section 62 to the Y-focussing electrode section 64 (or decrease, depending on the polarity of the ions). DC voltages are applied to the second transition electrodes 69 that have amplitudes between the amplitude of the DC voltage applied to the Y-focussing electrode section 64 and the amplitude of the DC voltage applied to the closest of the energy focussing electrodes 66. The different DC voltages applied to the respective different second transition electrodes 69 progressively decrease in a direction from the Y-focussing electrode section 64 to the energy focussing electrode section 66 (or increase, depending on the polarity of the ions). It will be appreciated that the potentials applied to the energy focussing electrode section 66 and the Y-focussing electrode section 64 are selected in order to ensure that ions which enter the ion mirror are able to pass through the Y-focussing electrode section 64, pass into the energy focussing electrode section 66, be reflected, pass back through the Y-focussing electrode section 64, and back out of the mirror.

The DC potential profile 65 along the ion mirror of this embodiment is shown in FIG. 6D. The potential profile 65 substantially corresponds to the conventional potential profile 61, except that it differs in the region between the ion entrance electrode section 62 and the energy focussing electrode section 66, as shown by the curved dashed line.

The spatial aberrations caused by a periodic lens will now be described.

Figure 7A:
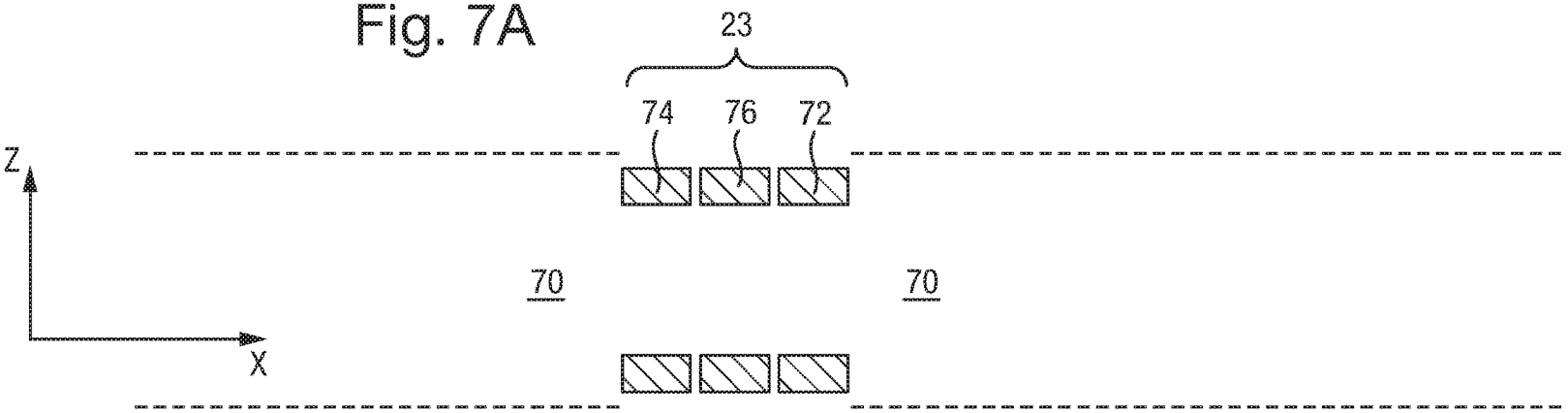
FIG. 7A shows a schematic of a prior art ion optical lens.

FIG. 7A shows a schematic of a cross-section in the X-Z plane of a known periodic lens, e.g. such as a periodic lens 23 of the type described in relation to FIGS. 2 and 4. As described previously, the lens is arranged between the ion mirrors such that ions pass from one of the ion mirrors to the lens, through the lens so as to be focussed in the Z-dimension as they pass therethrough, and then out of the lens towards the other ion mirror. The lens comprises three electrode sections 72,74,76 arranged along the device (in the X-dimension). A first ion entrance electrode section 72 is arranged at a first end of the device, an ion exit electrode section 74 is arranged at the opposite end of the device (in the X-dimension), and a Z-focussing electrode section 76 is arranged therebetween. In operation, the ion entrance and ion exit electrode sections 72,74 are maintained at the same DC potential as the ion entrance electrode sections of the ion mirrors. This maintains an electric field-free drift region 70 between the periodic lens and each of the ion mirrors. The Z-focussing electrode section 76 of the lens is maintained at a lower DC voltage than the ion entrance and ion exit electrode sections 72,74 of the lens so as to focus in the Z-dimension ions passing through the lens (or at a lower DC voltage, depending upon the polarity of the ions). The DC potential profile 71 along the X-dimension of the periodic lens is shown as the solid line in FIG. 7C and is formed such that the ions are initially accelerated by the potential profile.

This conventional periodic lens is acceptable for known MR-TOF-MS instruments. However, the periodic lens has relatively poor stigmatic or ion mapping properties at its operating potentials, primarily due to the large potential differences between the electrode sections of the lens, and partly due to the relatively small size of the lens.

Figure 7B:
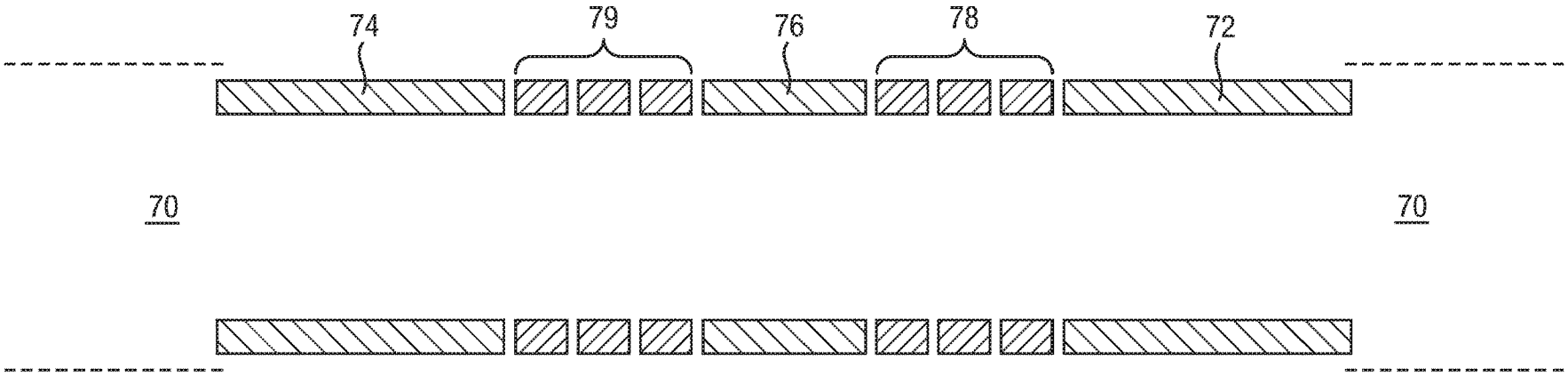
FIG. 7B shows a schematic of an ion lens according to an embodiment of the present invention.

FIG. 7B shows a schematic of a periodic lens according to an embodiment of the present invention. The lens is substantially the same as that shown in FIG. 7A, except that first transition electrodes 78 are arranged between the Z-focussing electrode section 76 and the ion entrance electrode section 72; and second transition electrodes 79 are arranged between the Z-focussing electrode section 76 and the ion exit electrode section 74. DC voltages are applied to the first transition electrodes 78 that have amplitudes between the amplitude of the DC voltage applied to the ion entrance electrode section 72 and the amplitude of the DC voltage applied to the Z-focussing electrode section 76. The different DC voltages applied to the respective different first transition electrodes 78 progressively decrease in a direction from the ion entrance electrode section 72 to the Z-focussing electrode section 76 (or increase, depending on the polarity of the ions). This creates a potential profile that initially accelerates the ions. DC voltages are applied to the second transition electrodes 79 that have amplitudes between the amplitude of the DC voltage applied to the Z-focussing electrode section 76 and the amplitude of the DC voltage applied to the ion exit electrode section 74. The different DC voltages applied to the respective different second transition electrodes 79 progressively increase in a direction from the Z-focussing electrode 76 to the ion exit electrode section 74 (or decrease, depending on the polarity of the ions). The DC potential profile 73 along the X-dimension of the ion lens is shown as the dashed line in FIG. 7C.

Additionally, the whole lens is substantially increased in length (in the X-dimension) and width (in the Z-dimension), as compared to a known periodic lens. More specifically, the length of the Z-focussing electrode section 76 and the lengths of the ion entrance and ion exit electrode sections 72,74 have been increased in length, and the widths of these sections have been increased.

Figure 7C:
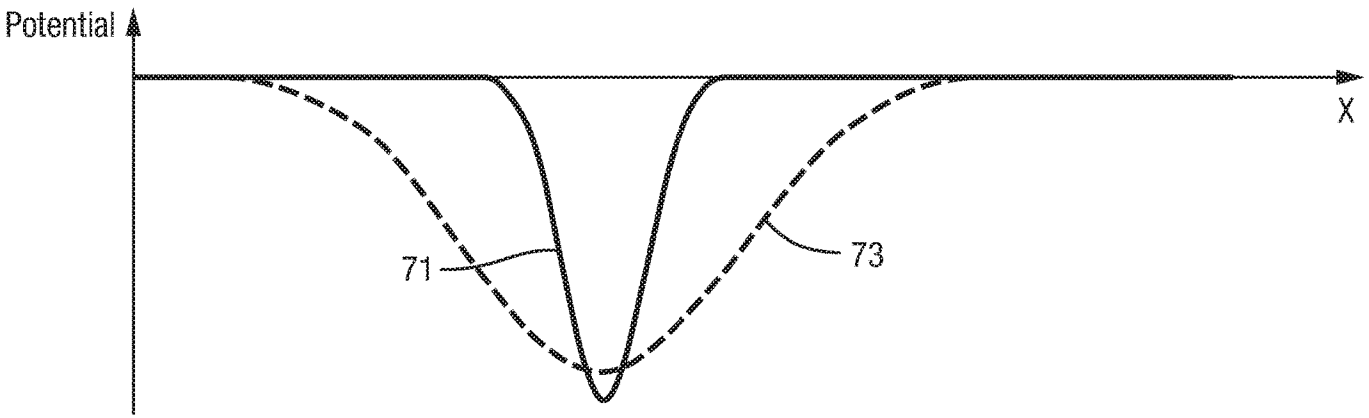
FIG. 7C shows the potential profiles along the longitudinal axes of the prior art ion lens and the ion lens according to the embodiment of the present invention.

As can be seen from FIG. 7C, the inclusion of the first and second transition electrodes 78,79 smoothes out the voltage transition between the electrode sections of the lens, as compared to the conventional lens. The larger size of the lens of the embodiment of the present invention also renders the variation in the potential profile 73 more gentle than that of the conventional potential profile 71. These features reduce the spatial aberrations caused by the lens and improve the ion mapping properties of the instrument.

The lens of this embodiment employs a potential profile for focussing ions in the Z-focussing section 76 that initially accelerates the ions. It is also possible to focus ions using a potential profile for focussing ions in the Z-focussing section 76 that initially decelerates the ions, although this is generally less preferred.

Figure 7D:
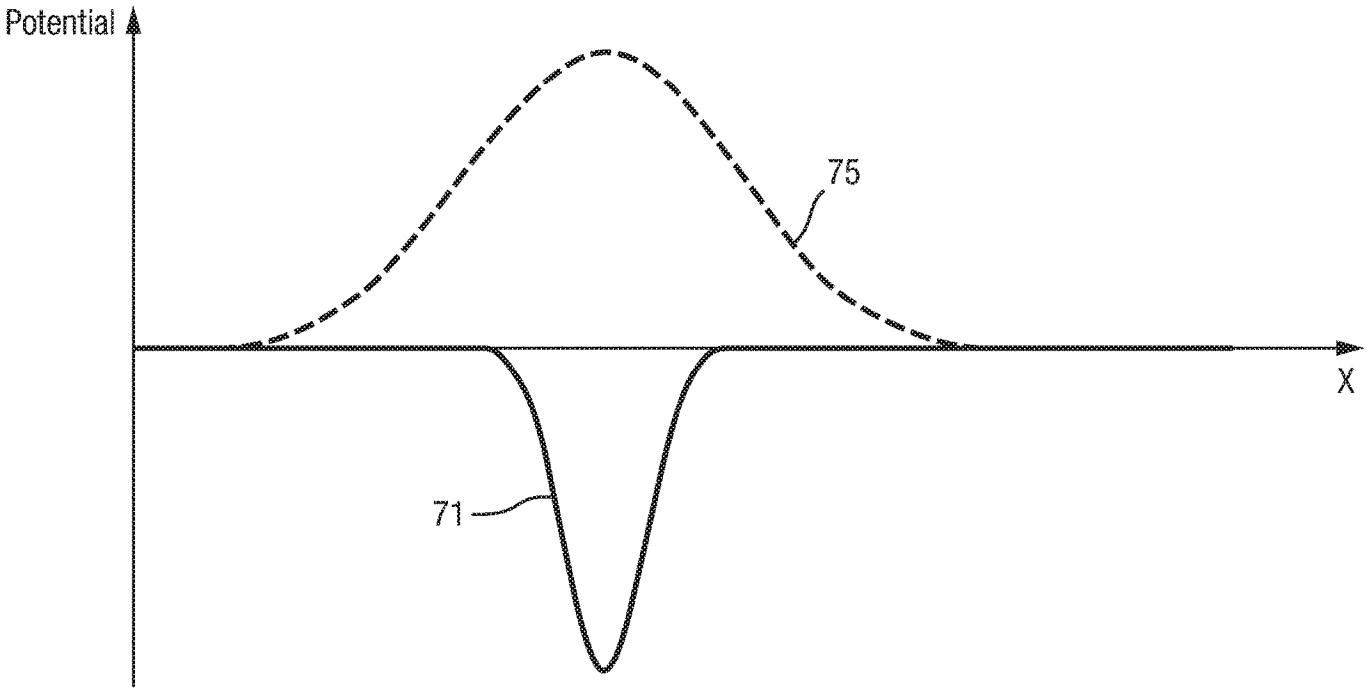
FIG. 7D shows the potential profiles along the longitudinal axes of the prior art ion lens and an ion lens according to another embodiment of the present invention.

FIG. 7D shows the conventional potential profile 71 that is shown in FIG. 7C and also shows a potential profile 75 along the X-dimension of a lens according to an embodiment of the present invention in which a potential profile is used for focussing ions in the Z-focussing section 76 that initially decelerates the ions. The lens is the same as that shown in FIG. 7B, but different DC voltages are applied to the electrodes. In this embodiment, the DC voltage applied to the Z-focussing electrode section 76 is above the DC voltages applied to the ion entrance and ion exit electrode sections 72,74. DC voltages are applied to the first transition electrodes 78 that have amplitudes between the amplitude of the DC voltage applied to the ion entrance electrode section 72 and the amplitude of the DC voltage applied to the Z-focussing electrode section 76. The different DC voltages applied to the respective different first transition electrodes 78 progressively increase in a direction from the ion entrance electrode section 72 to the Z-focussing electrode section 76 (or decrease, depending on the polarity of the ions). This creates a potential profile that initially decelerates the ions. DC voltages are applied to the second transition electrodes 79 that have amplitudes between the amplitude of the DC voltage applied to the Z-focussing electrode section 76 and the amplitude of the DC voltage applied to the ion exit electrode section 74. The different DC voltages applied to the respective different second transition electrodes 79 progressively decrease in a direction from the Z-focussing electrode 76 to the ion exit electrode section 74 (or increase, depending on the polarity of the ions).

As can be seen from FIG. 7D, the inclusion of the first and second transition electrodes 78,79 smoothes out the voltage transition between the electrode sections of the lens, as compared to the conventional lens. The larger size of the lens of the embodiment of the present invention also renders the variation in the potential profile 75 more gentle than that of the conventional potential profile 71. These features reduce the spatial aberrations caused by the lens and improve the ion mapping properties of the instrument.

The lens of the embodiments of the present invention may not completely focus the ions in the Z-dimension, but provides sufficient Z-focusing to prevent the ion beam from diverging excessively.

Figure 8:
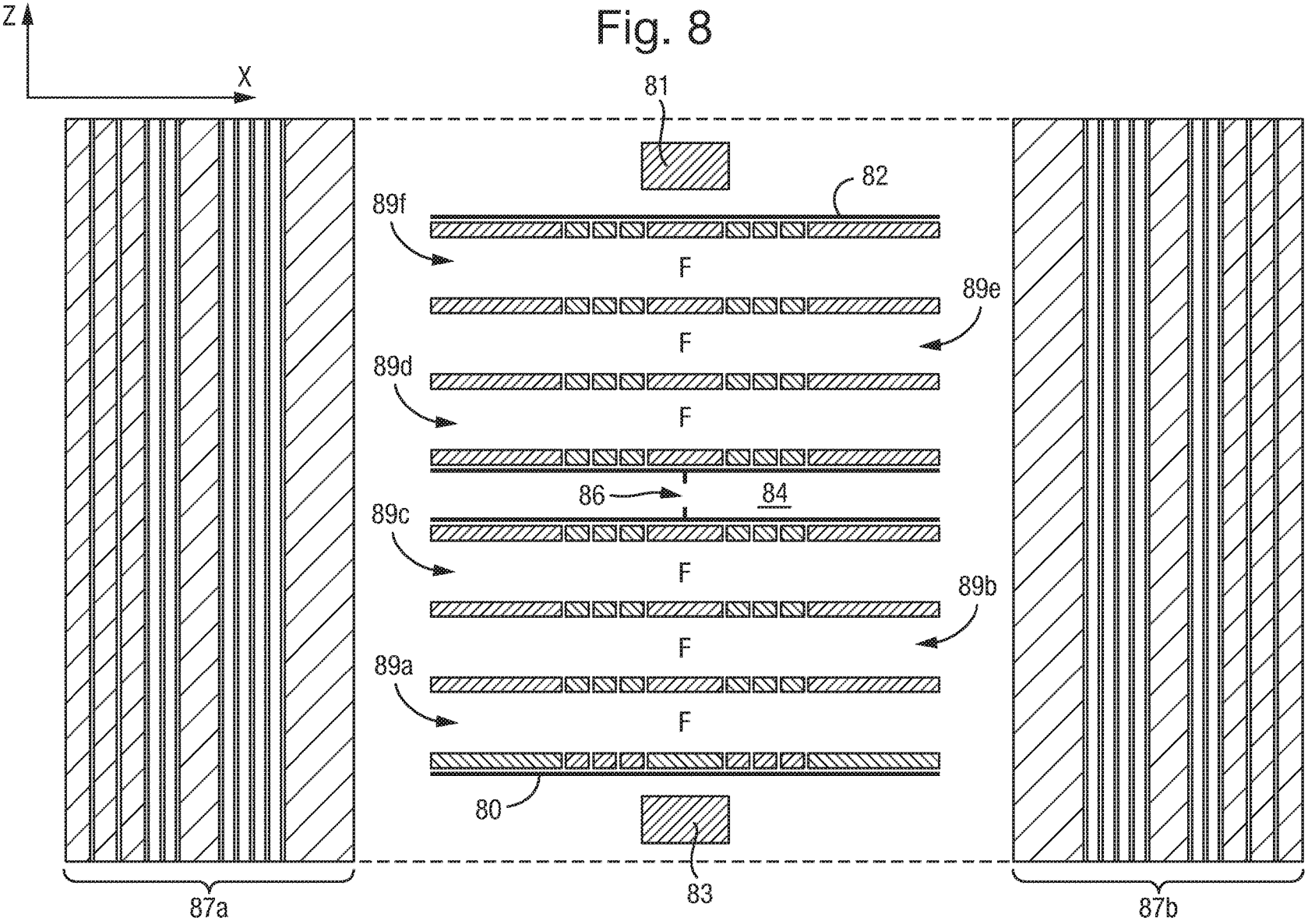
FIG. 8 shows a simplified schematic of an MR-TOF-MS instrument having ion mirrors and periodic lenses according to embodiments of the present invention.

FIG. 8 shows a schematic of an analyser according to an embodiment of the present invention. The analyser is similar to that described in relation to FIG. 4, although it includes ion mirrors 87 and periodic lenses 89 according to the embodiments of the present invention described above. As each of the periodic lenses 89 has an increased width (in the Z-dimension), as compared to a conventional periodic lens 23, fewer periodic lenses are provided per unit length in the Z-dimension. In the illustrated embodiment, the periodic lenses 89 provide six Z-focussing regions F that focus the ions in the Z-direction as they pass therethrough. The embodiment of FIG. 8 also differs from the analyser show in FIG. 4 in that the embodiment of FIG. 8 includes a position sensitive ion detector 81 onto which the source of ions 83 is mapped.

Also, a shielding electrode 80 is provided between the source of ions 83 and the adjacent periodic lens 89 such that ions exit the source 83 into a field-free region. A shielding electrode 82 is also provided between the detector 81 and the adjacent periodic lens 89 such that ions exiting the final periodic lens pass to the detector 81 through a field-free region. Additionally, shielding electrodes are provided in the centre (in the Z-dimension) of the array of periodic lenses so as to provide a field-free region 84. An aperture or slit 86 is provided in the field-free region 84 which only transmits ions that have not diverged excessively in the Z-dimension. This blocks the flight paths of ions that have diverged excessively in the Z-dimension and that would cause blurring of the image at the detector plane.

In operation, ions are pulsed from the source of ions 83 towards a first of the ions mirrors 87*a* in the X-Z plane and at an acute inclination angle to the X-dimension. The ions therefore have a velocity in the X-dimension and also a drift velocity in the Z-dimension. The ions enter into the first of the ion mirrors 87*a* and are reflected towards the second of the ion mirrors 87*b*. The angle at which the ions are injected is selected such that the ions reflected by the first ion mirror 87*a* have a sufficient drift velocity in the Z-dimension that they pass into an entrance end of the first periodic lens 89*a*. This lens 89*a* serves to focus the ions in the Z-dimension so as to prevent the ion beam expanding excessively in the Z-dimension. The ions then exit the other end of the periodic lens 89*a* and travel into the second ion mirror 87*b*. The ions are reflected by the second ion mirror 87*b* and the drift velocity of the ions in the Z-dimension causes the ions to enter into the second periodic lens 89*b*, which focuses the ions in the Z-dimension. The ions then exit the other end of the second periodic lens 89*b* and travel into the first ion mirror 87*a*. The ions are reflected again by the first ion mirror 87*a* and the drift velocity of the ions in the Z-dimension causes the ions to enter into the third periodic lens 89*c*, which focuses the ions in the Z-dimension. The ions then exit the other end of the periodic lens 89*c* and travel again into the second ion mirror 87*b*. The ions are reflected by the second ion mirror 87*b* and the drift velocity of the ions in the Z-dimension causes the ions to enter into the field-free region 84. Ions which have not diverged excessively in the Z-dimension are transmitted through aperture or slit 86 and then exit the field-free region 84.

The ions exiting the field-free region 84 travel into the first ion mirror 87*a*. The ions are reflected again by the first ion mirror 87*a* and the drift velocity of the ions in the Z-dimension causes the ions to enter into the fourth periodic lens 89*d*, which focuses the ions in the Z-dimension. The ions then exit the other end of the periodic lens 89*d* and travel into the second ion mirror 87*b*. The ions are reflected by the second ion mirror 87*b* and the drift velocity of the ions in the Z-dimension causes the ions to enter into the fifth periodic lens 89*e*, which focuses the ions in the Z-dimension. The ions then exit the other end of the fifth periodic lens 89*e* and travel into the first ion mirror 87*a*. The ions are reflected again by the first ion mirror 87*a* and the drift velocity of the ions in the Z-dimension causes the ions to enter into the sixth periodic lens 89*f*, which focuses the ions in the Z-dimension. The ions then exit the other end of the periodic lens 89*f* and travel again into the second ion mirror 87*b*. The ions are reflected by the second ion mirror 87*b* and the drift velocity of the ions in the Z-dimension causes the ions to impact on the position sensitive detector 81.

The ions separate, primarily in the X-dimension, according to their times of flight through the analyser. As such, ions of different mass to charge ratio arrive at the detector 81 at different times. The mass to charge ratio of any given ion can be determined from the duration between the time at which that ion was pulsed into the analyser by the source 83 and the time at which that ion was detected by the detector 81.

The ions may be focused in the Z-dimension by the periodic lenses 89 in a parallel to point manner by the time that the ions reach the aperture or slit 86. The focusing in the Z-dimension of the downstream periodic lenses 89 may then be set to allow the ions to be focused in a point to parallel manner. For example, in the X-Z plane the ions may be initially injected as a substantially parallel beam at the source 83 and the periodic lenses 89 may focus the ions in a parallel to point manner such that the ions are at their most focused in the Z-dimension at the location of the aperture or slit 86. Downstream of the aperture of slit 86, the periodic lenses 89 may focus the ions in a point to parallel manner such that the ions are parallel at the location of the detector 81.

Each reflection in each ion mirror 87 may focus the ions in the Y-dimension in a point to parallel manner. In other words, the ions may be focused in the Y-dimension by the ion mirrors 87 such that they have their narrowest width in the Y-dimension at a location between the ion mirrors 87. The ions may diverge as they travel from this focal point towards a given ion mirror 87 and may enter each ion mirror 87 as a substantially parallel ion beam (in the X-Y plane). The ion mirror 87 may then reflect and focus the ions back to the focal point between the ion mirrors 87. The ions may then diverge in the Y-dimension such that the ions may enter the next ion mirror 87 as a substantially parallel ion beam (in the X-Y plane). That ion mirror 87 may then reflect and focus the ions back to the focal point between the ion mirrors 87. This process may be repeated for each reflection for each ion mirror 87. Alternatively, each reflection in each ion mirror 87 may focus the ions in the Y-dimension in a parallel to point manner. In other words, the ions may be focused in the Y-dimension by the ion mirrors 87 such that they have their narrowest width in the Y-dimension within each ion mirror and are substantially parallel (in the X-Y pane) at a mid-way location between the ion mirrors 87.

The analyser according to FIG. 8 maps ions from the source of ions 83 to the detector 81, in the manner shown schematically in FIG. 3.

Figure 9A:
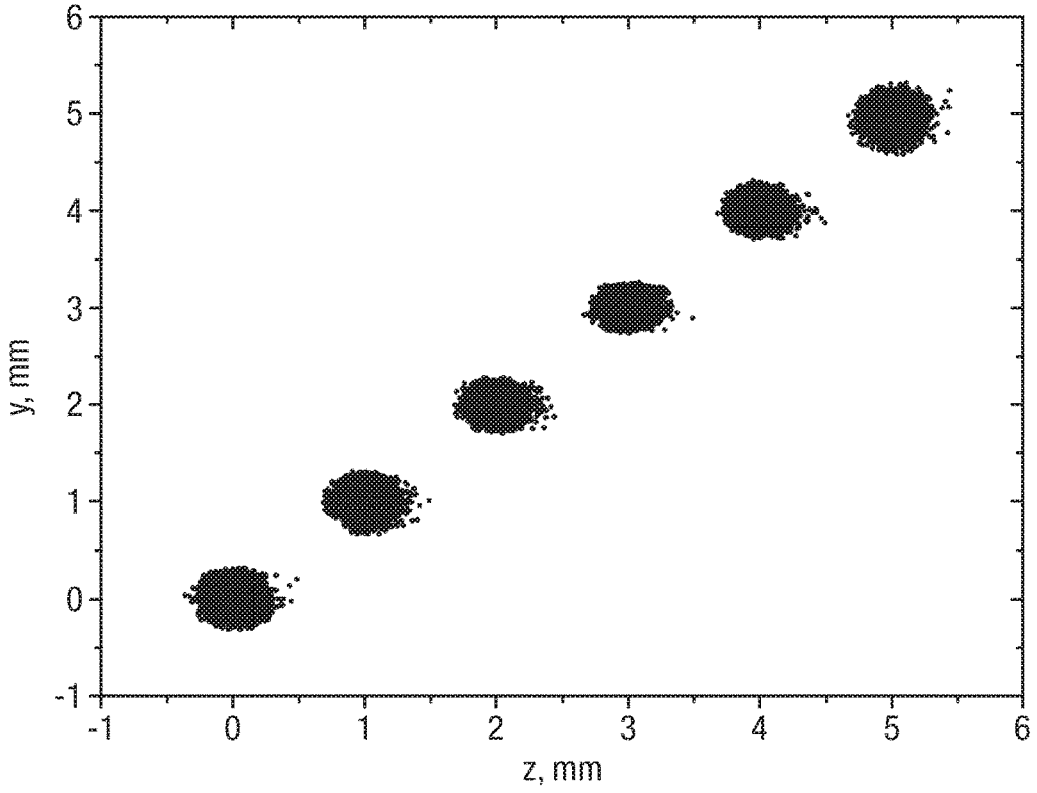
FIGS. 9A and 9B illustrate the performance of the analyser according to FIG. 8 in a macroscopic ion mapping mode.
Figure 9B:
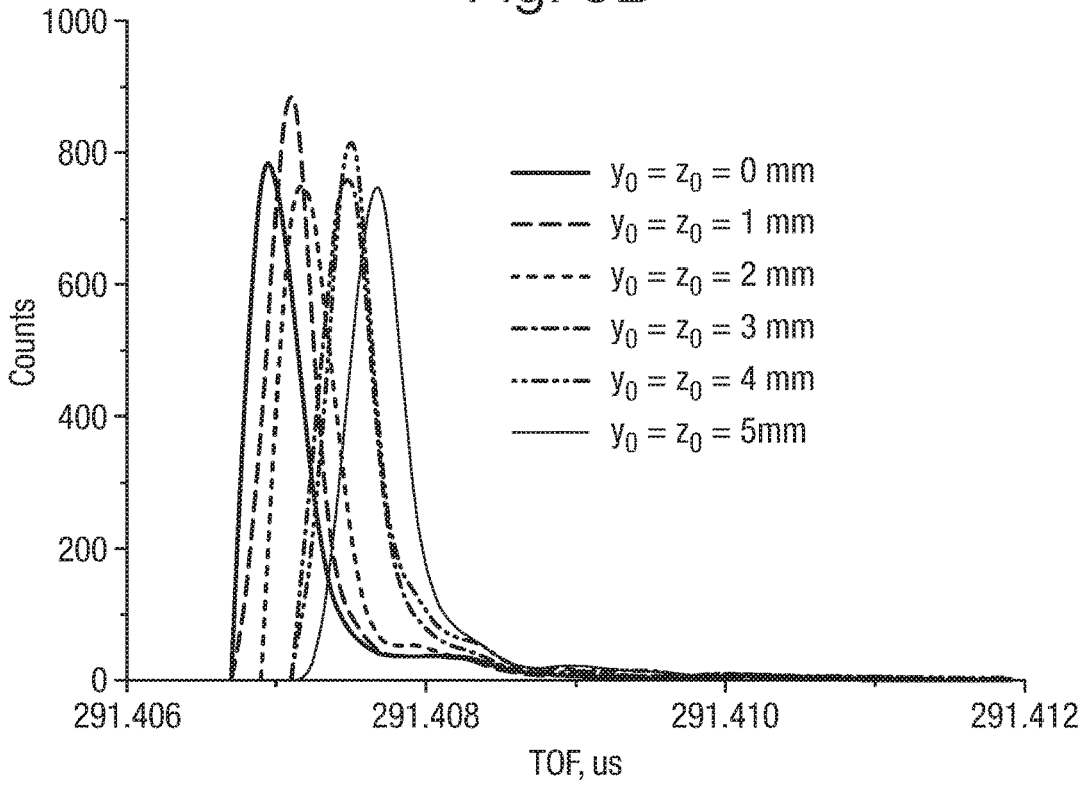

FIGS. 9A and 9B illustrate the performance of the analyser according to FIG. 8 in a macroscopic ion mapping mode. FIG. 9A shows an example of a simulation of the ions detected at the detector 81 when using a source of ions 83 that is a 2D array of macro-size pulsed ion beams. According to this example, a 6×6 array of pulsed ion beams (e.g. as shown in FIG. 3) was mapped from the source of ions to the position sensitive detector 81. Each ion beam in this simulation is generated so as to have a diameter of approximately 0.5 mm (in the Y-Z plane). The centres of adjacent ion beams in the array are initially separated from each other by 1 mm. The analyser then maps the image of this array, for example along a 10 m effective path length, to the detector plane almost without spatial distortions, as shown by FIG. 9A. Although the 2D array in this example was a 6×6 array of pulsed ion beams, only the ions detected from the ion beams having initial coordinates in the Y-Z plane of $Y_0=Z_0=0$, 1, 2, 3, 4 and 5 mm are shown. The ions detected from the other ion beams have been omitted from FIG. 9A for clarity, although a 6×6 array of ion beams would be detected at the detector 81.

Due to the improved spatial resolution of the analyser, the ion packets from different ion beams at the source of ions 83 are able to be mapped to separate spots on the ion detector 81. This system therefore allows parallel independent acquisitions of an array of ion beams or ion packets, with minimal ion losses and without any signal interference at the detector 81. This leads to an improvement in the throughput of the analyser. Although a 6×6 array of ion beams has been described, arrays of higher numbers of ion beams and larger fields of view may be provided using the analyzer.

The spatial resolution in the above example is around 750 microns, which is ideal for interfacing multiple input ion beams to the detector 81. Although the spatial resolution in this example is moderate in terms of the number of pixels resolved, TOF analysers are not conventionally able to sustain imaging properties at large fields of view. For example, the imaging field in a conventional TOF microscope is typically well under 1 mm.

FIG. 9B shows time profiles for ion packets detected in FIG. 9A having a mass to charge ratio of 1000 amu. The flight time is approximately 290 μs, while the FWHM aberration blurring of each ion packet is under 0.5 ns, allowing for initial time spreads of about 1 ns and a mass resolving power of about R≈100,000. This high value of resolution is unprecedented for multi-channel TOF mass spectrometers.

Figure 10:
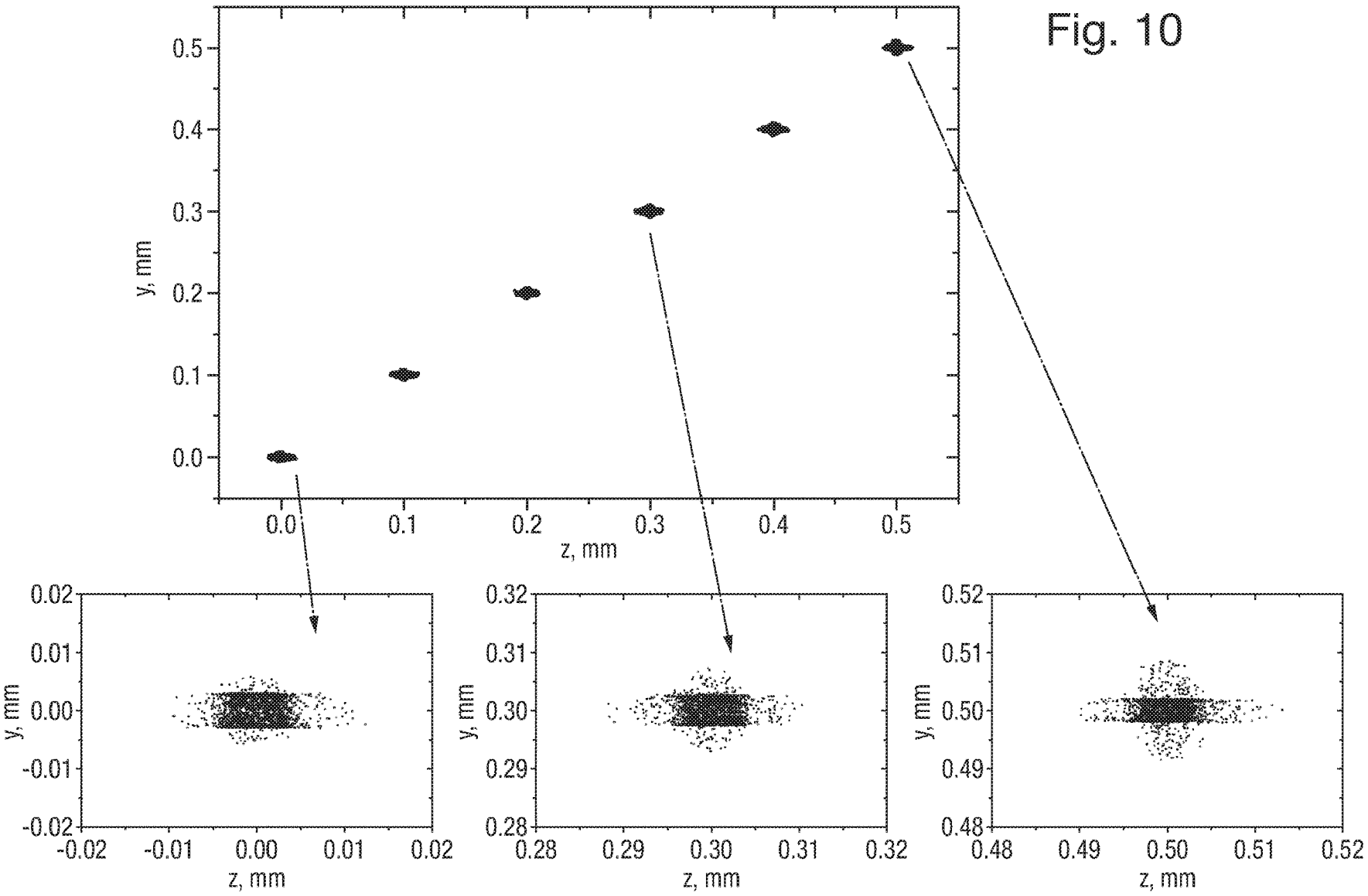
FIG. 10 illustrates the performance of the analyser according to FIG. 8 in a microscopic ion mapping mode.

FIG. 10 illustrates the performance of the analyser according to FIG. 8 in a microscopic ion mapping mode. The upper plot shown in FIG. 10 corresponds to that described in relation to FIG. 9A, except that each ion beam in this simulation is generated so as to have a smaller diameter (in the Y-Z plane), and the centres of adjacent ion beams in the array are initially separated from each other by 0.1 mm, rather than 1 mm. The lower three plots in FIG. 10 show expanded views of three of the spots on the detector 81 that are shown in the upper plot in FIG. 10. The spatial resolution in the microscope mode can be around 10 microns. This mode may be useful to simultaneously analyse ions from different areas of the same sample in parallel.

The analyser is able to operate in the microscopic mode with a field of view having a spatial resolution of 1 $mm^2$ and with a mass resolving power up to 100,000. Both of these values are superior over conventional TOF mass spectrometers.

Although the present invention has been described with reference to preferred embodiments, it will be understood by those skilled in the art that various changes in form and detail may be made without departing from the scope of the invention as set forth in the accompanying claims.

The invention claimed is:

1. An ion mirror comprising:

an ion entrance electrode section at the ion entrance to the ion mirror;

an energy focussing electrode section for reflecting ions back along a longitudinal axis towards said ion entrance;

a spatial focussing electrode section arranged between the ion entrance electrode section and the energy focussing electrode section for spatially focussing the ions;

one or more DC voltage supply configured to apply different DC voltages to the ion entrance electrode section, the spatial focussing electrode section and the energy focussing electrode section, and to apply a DC potential to the ion entrance electrode section that is intermediate the DC potential applied to the spatial focussing electrode section and the DC potential applied to the energy focussing electrode section;

wherein at least one first transition electrode is arranged between said ion entrance electrode section and said spatial focussing electrode section, wherein said one or more DC voltage supply is configured to apply a DC potential to said at least one first transition electrode that is intermediate the DC potential applied to the ion entrance electrode section and the DC potential applied to the spatial focussing electrode section; and wherein at least one second transition electrode is arranged between said energy focussing electrode section and said spatial focussing electrode section, wherein said one or more DC voltage supply is configured to apply a DC potential to said at least one second transition electrode that is intermediate the DC potential applied to the spatial focussing electrode section and the DC potential applied to the ion entrance electrode section.

2. The ion mirror of claim 1, wherein the DC voltage supply is configured to apply multiple different DC potentials to different electrodes of the energy focussing electrode section for reflecting ions back along the longitudinal axis towards said ion entrance; and wherein the DC voltage supply is configured to apply a DC potential to the ion entrance electrode section that is intermediate the DC potential applied to the spatial focussing electrode section and the lowest DC potential applied to the energy focussing electrode section.

3. The ion mirror of claim 1, wherein the spatial focussing electrode section focuses ions in a dimension (Y-dimension) that is orthogonal to said longitudinal axis (X-dimension).

4. The ion mirror of claim 1, wherein the energy focussing electrode section comprises at least two electrodes at different positions along the longitudinal axis, wherein the DC voltage supply is configured to apply a different potential to each of the at least two electrodes so as to provide an electric potential profile along the energy focussing electrode section for reflecting ions along the longitudinal axis towards said ion entrance.

5. The ion mirror of claim 1, wherein said at least one first transition electrode comprises ≥m first transition electrodes arranged at different positions along the longitudinal axis, wherein m is selected from the group comprising: 2; 3; 4; 5; 6; 7; 8; 9; and 10.

6. The ion mirror of claim 5, wherein the voltage supply is configured to apply a different DC potential to each of the m first transition electrodes so as to provide an electric potential profile that progressively increases in a direction along said longitudinal axis from the spatial focussing section to the ion entrance section.

7. The ion mirror of claim 1, wherein said at least one second transition electrode comprises ≥n second transition electrodes arranged at different positions along the longitudinal axis, wherein n is selected from the group comprising: 2; 3; 4; 5; 6; 7; 8; 9; and 10.

8. The ion mirror of claim 7, wherein the voltage supply is configured to apply a different DC potential to each of the n second transition electrodes so as to provide an electric potential profile that progressively increases in a direction along said longitudinal axis from the spatial focussing section to the energy focussing electrode section.

9. An ion mirror comprising:

an ion entrance electrode section at the ion entrance to the ion mirror;

an energy focussing electrode section for reflecting ions back along a longitudinal axis towards said ion entrance;

a spatial focussing electrode section arranged between the ion entrance electrode section and the energy focussing electrode section for spatially focussing the ions;

one or more DC voltage supply configured to apply different DC voltages to the ion entrance electrode section, the spatial focussing electrode section and the energy focussing electrode section, and to apply a DC potential to the spatial focussing electrode section that is intermediate the DC potential applied to the ion entrance electrode section and a DC potential applied to the energy focussing electrode section; and wherein at least one first transition electrode is arranged between said ion entrance electrode section and said spatial focussing electrode section, wherein said one or more DC voltage supply is configured to apply a DC potential to said at least one first transition electrode that is intermediate the DC potential applied to the ion entrance electrode section and the DC potential applied to the spatial focussing electrode section; and wherein at least one second transition electrode is arranged between said energy focussing electrode section and said spatial focussing electrode section, wherein said one or more DC voltage supply is configured to apply a DC potential to said at least one second transition electrode that is below the DC potential applied to the spatial focussing electrode section.

10. A mass spectrometer comprising an ion mirror as claimed in claim 1; or comprising two ion mirrors, each of the type claimed in claim 1, wherein the spectrometer is configured such that, in use, ions are reflected between the two ion mirrors, wherein the spectrometer is a time of flight mass spectrometer.

11. A time of flight mass spectrometer comprising:

a time of flight region for separating ions according to their mass to charge ratio; and an ion optical lens for spatially focussing ions arranged within the time of flight region, said lens comprising:

an ion entrance electrode section and an ion exit electrode section at opposite ends of the lens, and a spatial focussing electrode section arranged between the ion entrance and ion exit electrode sections for spatially focussing ions passing through the lens;

one or more DC voltage supply configured to apply DC voltages to the ion entrance electrode section, the spatial focussing electrode section and the ion exit electrode section; and to apply a DC potential to the spatial focussing electrode section that is either lower or greater than both the DC potential applied to the ion entrance electrode section and the DC potential applied to the ion exit electrode section;

at least one first transition electrode arranged between said ion entrance electrode section and said spatial focussing electrode section, wherein said one or more DC voltage supply is configured to apply a DC potential to said at least one first transition electrode that is intermediate the DC potential applied to the ion entrance electrode section and the DC potential applied to the spatial focussing electrode section; and at least one second transition electrode arranged between said ion exit electrode section and said spatial focussing electrode section, wherein said one or more DC voltage supply is configured to apply a DC potential to said at least one second transition electrode that is intermediate the DC potential applied to the ion exit electrode section and the DC potential applied to the spatial focussing electrode section.

12. The spectrometer of claim 11, wherein said at least one first transition electrode comprises ≥p first transition electrodes arranged at different positions along the longitudinal axis, wherein p is selected from the group comprising: 2; 3; 4; 5; 6; 7; 8; 9; and 10; and/or wherein said at least one second transition electrode comprises ≥q second transition electrodes arranged at different positions along the longitudinal axis, wherein q is selected from the group comprising: 2; 3; 4; 5; 6; 7; 8; 9; and 10.

13. The spectrometer of claim 12, wherein the voltage supply is configured to apply a different DC potential to each of the p first transition electrodes so as to provide an electric potential profile that either progressively decreases in a direction along said longitudinal axis from the ion entrance electrode section to the spatial focussing section, and wherein the voltage supply is configured to apply a different DC potential to each of the q second transition electrodes so as to provide an electric potential profile that either progressively decreases in a direction along said longitudinal axis from the ion exit electrode section to the spatial focussing section; or wherein the voltage supply is configured to apply a different DC potential to each of the p first transition electrodes so as to provide an electric potential profile that progressively increases in a direction along said longitudinal axis from the ion entrance electrode section to the spatial focussing section, and wherein the voltage supply is configured to apply a different DC potential to each of the q second transition electrodes so as to provide an electric potential profile that progressively increases in a direction along said longitudinal axis from the ion exit electrode section to the spatial focussing section.

14. The spectrometer of claim 11, comprising a plurality of ion lenses, each lens configured as claimed in claim 11.

15. The spectrometer of claim 14, wherein the plurality of ion lenses are arranged adjacent to one another with their longitudinal axes in parallel and extending in a direction between first and second ion mirrors.

16. The spectrometer of claim 15, wherein one or more shielding electrodes is arranged laterally between adjacent ion lenses for providing an electric field free-region between the adjacent lenses and such that, in use, ions travel through the electric field free-region in between travelling through the laterally adjacent lenses; and wherein an apertured or slotted member is provided in the electric field free-region for blocking the flight paths of ions that have diverged in the direction perpendicular to the longitudinal axis by more than a threshold amount, and for transmitting ions through the aperture or slot that have flight paths which have diverged in the direction perpendicular to the longitudinal axis by less than a threshold amount.

17. A method of reflecting ions or mass spectrometry comprising:

supplying ions to the ion entrance electrode section of an ion mirror as claimed in claim 1;

applying a DC potential to the ion entrance electrode section that is intermediate the DC potential applied to the spatial focussing electrode section and the DC potential applied to the energy focussing electrode section; and at least one of:

(i) applying a DC potential to said at least one first transition electrode that is intermediate the DC potential applied to the ion entrance electrode section and the DC potential applied to the spatial focussing electrode section; and/or (ii) applying a DC potential to said at least one second transition electrode that is intermediate the DC potential applied to the spatial focussing electrode section and the DC potential applied to the ion entrance electrode section.

18. A method of reflecting ions or mass spectrometry comprising:

supplying ions to the ion entrance electrode section of an ion mirror as claimed in claim 9;

applying a DC potential to the ion entrance electrode section that is intermediate the DC potential applied to the spatial focussing electrode section and the DC potential applied to the energy focussing electrode section; and at least one of:

(i) applying a DC potential to said at least one first transition electrode that is intermediate the DC potential applied to the ion entrance electrode section and the DC potential applied to the spatial focussing electrode section; and/or (ii) applying a DC potential to said at least one second transition electrode that is below the DC potential applied to the spatial focussing electrode section.

19. A method of time of flight mass spectrometry comprising:

providing a spectrometer as claimed in claim 11;

separating ions according to their mass to charge ratio in the time of flight region;

spatially focussing ions within the time of flight region using the ion optical lens by:

applying a DC potential to the spatial focussing electrode section that is either lower or greater than both the DC potential applied to the ion entrance electrode section and the DC potential applied to the ion exit electrode section; and at least one of:

(i) applying a DC potential to said at least one first transition electrode that is intermediate the DC potential applied to the ion entrance electrode section and the DC potential applied to the spatial focussing electrode section; and/or (ii) applying a DC potential to said at least one second transition electrode that is intermediate the DC potential applied to the ion exit electrode section and the DC potential applied to the spatial focussing electrode section.

20. The spectrometer of claim 11 wherein the ion optical lens is arranged between and spaced apart from two ion mirrors.

* * * * *